US006464154B1

(12) United States Patent
Heaslip et al.

(10) Patent No.: US 6,464,154 B1
(45) **Date of Patent: *Oct. 15, 2002**

(54) CASTING NOZZLE WITH DIAMOND-BACK INTERNAL GEOMETRY AND MULTI-PART CASTING NOZZLE WITH VARYING EFFECTIVE DISCHARGE ANGLES AND METHOD FOR FLOWING LIQUID METAL THROUGH SAME

(75) Inventors: Lawrence John Heaslip, Burlington (CA); James Derek Dorricott, Burlington (CA)

(73) Assignee: Versuvius Crucible Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,138

(22) Filed: Jun. 14, 2001

Related U.S. Application Data

(63) Continuation of application No. 09/435,571, filed on Nov. 8, 1999, which is a division of application No. 08/935,089, filed on Sep. 26, 1997, now Pat. No. 6,027,051, which is a continuation-in-part of application No. 08/725,589, filed on Oct. 3, 1996, now Pat. No. 5,944,261, which is a continuation-in-part of application No. 08/233,049, filed on Apr. 25, 1994, now Pat. No. 5,785,880.

(51) Int. Cl.[7] ..... B05B 1/14
(52) U.S. Cl. ..... 239/590.5; 239/553; 222/603
(58) Field of Search ..... 239/590.5, 590, 239/591, 553, 553.5, 588, 599; 222/603, 606

(56) References Cited

U.S. PATENT DOCUMENTS

| | | | | |
|---|---|---|---|---|
| 981,611 A | | 1/1911 | Schuchardt | |
| 3,708,126 A | * | 1/1973 | De Kinkelder | 239/590.5 |
| 3,848,811 A | | 11/1974 | Fryback | |
| 4,566,614 A | * | 1/1986 | Frykendahl | 222/603 |
| 4,671,433 A | | 6/1987 | Podrina et al. | |
| 4,858,794 A | | 8/1989 | Sugiura et al. | |
| 5,198,126 A | * | 3/1993 | Lee | 222/606 |
| 5,314,099 A | * | 5/1994 | Butz et al. | 222/606 |
| 5,785,880 A | * | 7/1998 | Heaslip et al. | 222/594 |
| 5,944,261 A | * | 8/1999 | Heaslip et al. | 239/553.5 |
| 6,027,051 A | * | 2/2000 | Heaslip et al. | 239/590.5 |

FOREIGN PATENT DOCUMENTS

| | | | |
|---|---|---|---|
| CA | 9529025 | A | 11/1995 |
| DE | 3709188 | A | 9/1988 |
| DE | 4116723 | A | 6/1992 |
| DE | 4142447 | A | 12/1992 |
| DE | 4319966 | A | 12/1994 |
| EP | 0254909 | A | 2/1988 |
| EP | 0403808 | A | 12/1990 |
| EP | 0482423 | A | 11/1995 |
| EP | 0685282 | A | 12/1995 |
| EP | 0694359 | A | 1/1996 |
| EP | 0709153 | A | 5/1996 |
| GB | 947189 | A | 1/1959 |
| GB | 8912519 | A | 12/1989 |
| JP | 111321 | A | 5/1993 |
| JP | 61-226149 | A | 10/1996 |

* cited by examiner

*Primary Examiner*—Lesley D. Morris
*Assistant Examiner*—Dinh Q. Nguyen
(74) *Attorney, Agent, or Firm*—James R. Williams

(57) ABSTRACT

A method and apparatus for flowing liquid metal through a casting nozzle includes an elongated bore having at least one entry port, at least one upper exit port, and at least one lower exit port. A baffle is positioned proximate to the upper exit port to divide the flow of liquid metal through the bore into at least one outer stream and a central stream, the outer stream flowing through the upper exit port and the central stream flowing past the baffle and toward the lower exit port. The baffle is adapted to allocate the proportion of liquid metal divided between the outer stream and the central stream so that the effective discharge angle of the outer stream exiting through the upper exit port varies based on the flow throughput of liquid metal through the casting nozzle.

22 Claims, 20 Drawing Sheets

FIG. 1a
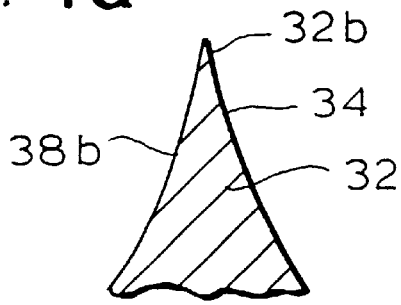
FIG. 17a
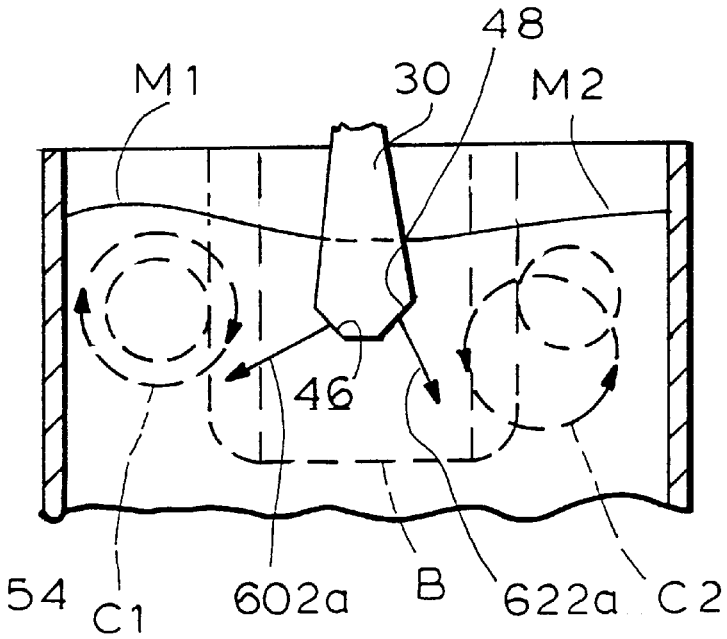
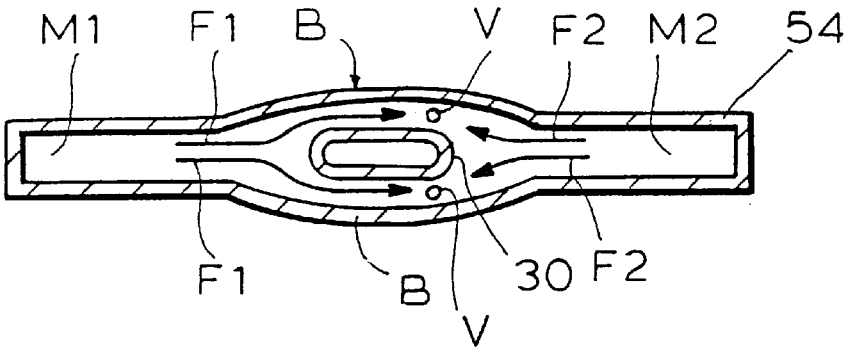
FIG. 17b

FIG. 7
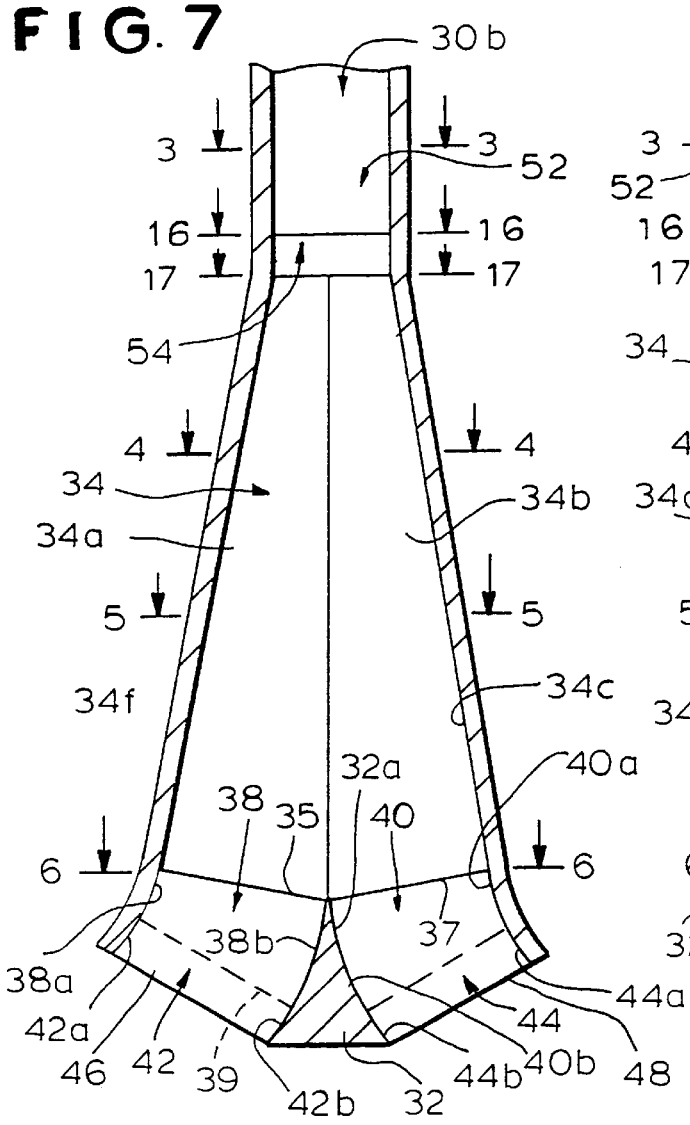
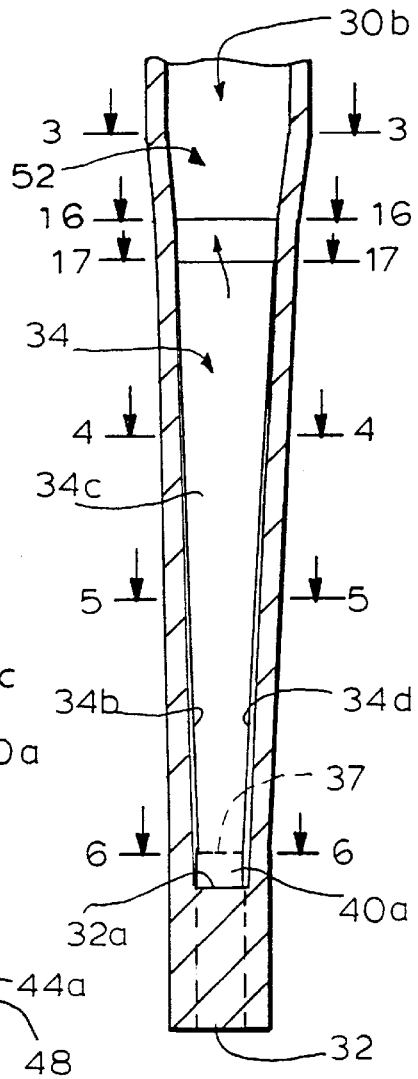
FIG. 8
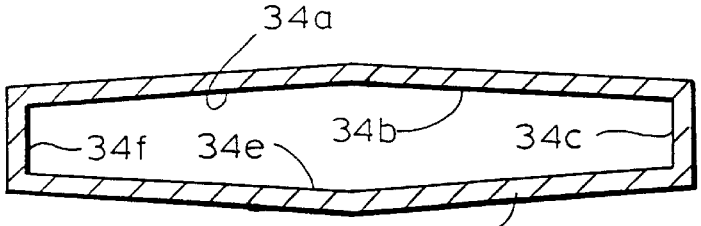
FIG. 6a
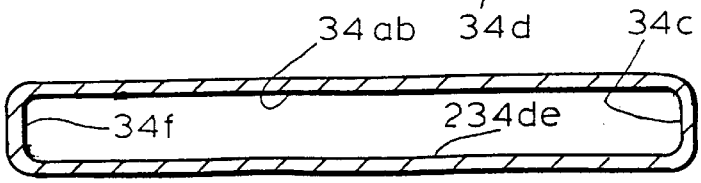
FIG. 6b

CASTING NOZZLE WITH DIAMOND-BACK INTERNAL GEOMETRY AND MULTI-PART CASTING NOZZLE WITH VARYING EFFECTIVE DISCHARGE ANGLES AND METHOD FOR FLOWING LIQUID METAL THROUGH SAME

CROSS-REFERENCE TO RELATED APPLICATIONS

This application is a continuation application of Ser. No. 09/435,571, filed Nov. 8, 1999, which is a divisional application of U.S. application Ser. No. 08/935,089, filed Sep. 26, 1997 now U.S. Pat. No. 6,027,051 Ser. No. 08/725,589, which is a continuation-in-part of U.S. Pat. No. 5,944,261, filed Oct. 3, 1996 Ser. No. 08/233,049, which is a continuation-in-part of U.S. Pat. No. 5,785,880, filed Apr. 25, 1994.

BACKGROUND OF THE INVENTION

1. Field of the Invention

The present invention relates to a casting or submerged entry nozzle and more particularly to a casting or submerged entry nozzle that improves the flow behavior associated with the introduction of liquid metal into a mold through a casting nozzle.

2. Description of the Related Art

In the continuous casting of steel (e.g. slabs) having, for example, thicknesses of 50 to 60 mm and widths of 975 to 1625 mm, there is often employed a casting or submerged entry nozzle. The casting nozzle contains liquid steel as it flows into a mold and introduces the liquid metal into the mold in a submerged manner.

The casting nozzle is commonly a pipe with a single entrance on one end and one or two exits located at or near the other end. The inner bore of the casting nozzle between the entrance region and the exit region is often simply a cylindrical axially symmetric pipe section.

The casting nozzle has typical outlet dimensions of 25 to 40 mm widths and 150 to 250 mm lengths. The exit region of the nozzle may simply be an open end of the pipe section. The nozzle may also incorporate two oppositely directed outlet ports in the sidewall of the nozzle where the end of the pipe is closed. The oppositely directed outlet ports deflect molten steel streams at apparent angles between 10–90° relative to the vertical. The nozzle entrance is connected to the source of a liquid metal. The source of liquid metal in the continuous casting process is called a tundish.

The purposes of using a casting nozzle are:

(1) to carry liquid metal from the tundish into the mold without exposing the liquid metal to air;

(2) to evenly distribute the liquid metal in the mold so that heat extraction and solidified shell formation are uniform; and (3) to deliver the liquid metal to the mold in a quiescent and smooth manner, without excessive turbulence particularly at the meniscus, so as to allow good lubrication, and minimize the potential for surface defect formation.

The rate of flow of liquid metal from the tundish into the casting nozzle may be controlled in various ways. Two of the more common methods of controlling the flow rate are: (1) with a stopper rod, and (2) with a slide gate valve. In either instance, the nozzle must mate with the tundish stopper rod or tundish slide gate and the inner bore of the casting nozzle in the entrance region of the nozzle is generally cylindrical and may be radiused or tapered.

Heretofore, prior art casting nozzles accomplish the aforementioned first purpose if they are properly submerged within the liquid steel in the mold and maintain their physical integrity.

Prior art nozzles, however, do not entirely accomplish the aforementioned second and third purposes. For example, FIGS. 19 and 20 illustrate a typical design of a two-ported prior art casting nozzle with a closed end. This nozzle attempts to divide the exit flow into two opposing outlet streams. The first problem with this type of nozzle is the acceleration of the flow within the bore and the formation of powerful outlets which do not fully utilize the available area of the exit ports. The second problem is jet oscillation and unstable mold flow patterns due to the sudden redirection of the flow in the lower region of the nozzle. These problems do not allow even flow distribution in the mold and cause excessive turbulence.

FIG. 20 illustrates an alternative design of a two-ported prior art casting nozzle with a pointed flow divider end. The pointed divider attempts to improve exit jet stability. However, this design experiences the same problems as those encountered with the design of FIG. 18. In both cases, the inertial force of the liquid metal traveling along the bore towards the exit port region of the nozzle can be so great that it cannot be deflected to fill the exit ports without flow separation at the top of the ports. Thus, the exit jets are unstable, produce oscillation and are turbulent.

Moreover, the apparent deflection angles are not achieved. The actual deflection angles are appreciably less. Furthermore, the flow profiles in the outlet ports are highly non-uniform with low flow velocity at the upper portion of the ports and high flow velocity adjacent the lower portion of the ports. These nozzles produce a relatively large standing wave in the meniscus or surface of the molten steel, which is covered with a mold flux or mold powder for the purpose of lubrication. These nozzles further produce oscillation in the standing wave wherein the meniscus adjacent one mold end alternately rises and falls and the meniscus adjacent the other mold end alternately falls and rises. Prior art nozzles also generate intermittent surface vortices. All of these effects tend to cause entrainment of mold flux in the body of the steel slab, reducing its quality. Oscillation of the standing wave causes unsteady heat transfer through the mold at or near the meniscus. This effect deleteriously affects the uniformity of steel shell formation, mold powder lubrication, and causes stress in the mold copper. These effects become more and more severe as the casting rate increases; and consequently it becomes necessary to limit the casting rate to produce steel of a desired quality.

Referring now to FIG. 17, there is shown a nozzle 30 similar to that described in European Application 0403808. As is known to the art, molten steel flows from a tundish through a valve or stopper rod into a circular inlet pipe section 30*b*. Nozzle 30 comprises a circular-to-rectangular main transition 34. The nozzle further includes a flat-plate flow divider 32 which directs the two streams at apparent plus and minus 90° angles relative to the vertical. However, in practice the deflection angles are only plus and minus 45°. Furthermore, the flow velocity in outlet ports 46 and 48 is not uniform. Adjacent the right diverging side wall 34C of transition 34 the flow velocity from port 48 is relatively low as indicated by vector 627. Maximum flow velocity from port 48 occurs very near flow divider 32 as indicated by vector 622. Due to friction, the flow velocity adjacent divider 32 is slightly less, as indicated by vector 621. The non-uniform flow from outlet port 48 results in turbulence. Furthermore, the flow from ports 46 and 48 exhibit a low frequency oscillation of plus and minus 20° with a period of from 20 to 60 seconds. At port 46 the maximum flow velocity is indicated by vector 602 which corresponds to vector 622 from port 48. Vector 602 oscillates between two extremes, one of which is vector 602*a*, displaced by 65° from the vertical and the other of which is vector 602*b*, displaced by 25° from the vertical.

As shown in FIG. 17*a*, the flows from ports 46 and 48 tend to remain 90° relative to one another so that when the output from port 46 is represented by vector 602*a*, which is deflected by 65° from the vertical, the output from port 48 is represented by vector 622*a* which is deflected by 25° from the vertical. At one extreme of oscillation shown in FIG. 17*a*, the meniscus M1 at the left-hand end of mold 54 is considerably raised while the meniscus M2 at the right mold end is only slightly raised. The effect has been shown greatly exaggerated for purposes of clarity. Generally, the lowest level of the meniscus occurs adjacent nozzle 30. At a casting rate of three tons per minute, the meniscus generally exhibits standing waves of 18 to 30 mm in height. At the extreme of oscillation shown, there is a clockwise circulation C1 of large magnitude and low depth in the left mold end and a counter-clockwise circulation C2 of lesser magnitude and greater depth in the right mold end.

As shown in FIGS. 17*a* and 17*b*, adjacent nozzle 30 there is a mold bulge region B where the width of the mold is increased to accommodate the nozzle, which has typical refractory wall thicknesses of 19 mm. At the extreme of oscillation shown in FIG. 17*a*, there is a large surface flow F1 from left-to-right into the bulge region in front of and behind nozzle 30. There is also a small surface flow F2 from right-to-left toward the bulge region. Intermittent surface vortices V occur in the meniscus in the mold bulge region adjacent the right side of nozzle 30. The highly non-uniform velocity distribution at ports 46 and 48, the large standing waves in the meniscus, the oscillation in the standing waves, and the surface vortices all tend to cause entrainment of mold powder or mold flux with a decrease in the quality of the cast steel. In addition, steel shell formation is unsteady and non-uniform, lubrication is detrimentally affected, and stress within mold copper at or near the meniscus is generated. All of these effects are aggravated at higher casting rates. Such prior art nozzles require that the casting rate be reduced.

Referring again to FIG. 17, the flow divider may alternately comprise an obtuse triangular wedge 32*c* having a leading edge included angle of 156°, the sides of which are disposed at angles of 12° from the horizontal, as shown in a first German Application DE 3709188, which provides apparent deflection angles of plus and minus 78°. However, the actual deflection angles are again approximately plus and minus 45°; and the nozzle exhibits the same disadvantages as before.

Referring now to FIG. 18, nozzle 30 is similar to that shown in a second German Application DE 4142447 wherein the apparent deflection angles are said to range between 10 and 22°. The flow from the inlet pipe 30*b* enters the main transition 34 which is shown as having apparent deflection angles of plus and minus 20° as defined by its diverging side walls 34*c* and 34*f* and by triangular flow divider 32. If flow divider 32 were omitted, an equipotential of the resulting flow adjacent outlet ports 46 and 48 is indicated at 50. Equipotential 50 has zero curvature in the central region adjacent the axis S of pipe 30*b* and exhibits maximum curvature at its orthogonal intersection with the right and left sides 34*c* and 34*f* of the nozzle. The bulk of the flow in the center exhibits negligible deflection; and only flow adjacent the sides exhibits a deflection of plus and minus 20°. In the absence of a flow divider, the mean deflections at ports 46 and 48 would be less than ¼ and perhaps ⅕ or 20% of the apparent deflection of plus and minus 20°.

Neglecting wall friction for the moment, 64*a* is a combined vector and streamline representing the flow adjacent the left side 34*f* of the nozzle and 66*a* is a combined vector and streamline representing the flow adjacent the right side 34*c* of the nozzle. The initial point and direction of the streamline correspond to the initial point and direction of the vector; and the length of the streamline corresponds to the length of the vector. Streamlines 64*a* and 66*a* of course disappear into the turbulence between the liquid in the mold and the liquid issuing from nozzle 30. If a short flow divider 32 is inserted, it acts substantially as a truncated body in two dimensional flow. The vector-streamlines 64 and 66 adjacent the body are of higher velocity than the vector-streamlines 64*a* and 66*a*. Streamlines 64 and 66 of course disappear into the low pressure wake downstream of flow divider 32. This low pressure wake turns the flow adjacent divider 32 downwardly. The latter German application shows the triangular divider 32 to be only 21% of the length of main transition 34. This is not sufficient to achieve anywhere near the apparent deflections, which would require a much longer triangular divider with corresponding increase in length of the main transition 34. Without sufficient lateral deflection, the molten steel tends to plunge into the mold. This increases the amplitude of the standing wave, not by an increase in height of the meniscus at the mold ends, but by an increase in the depression of the meniscus in that portion of the bulge in front of and behind the nozzle where flow therefrom entrains liquid from such portion of the bulge and produces negative pressures.

The prior art nozzles attempt to deflect the streams by positive pressures between the streams, as provided by a flow divider.

Due to vagaries in manufacture of the nozzle, the lack of the provision of deceleration or diffusion of the flow upstream of flow division and to low frequency oscillation in the flows emanating from ports 46 and 48, the center streamline of the flow will not generally strike the point of triangular flow divider 32 of FIG. 18. Instead, the stagnation point generally lies on one side or the other of divider 32. For example, if the stagnation point is on the left side of divider 32 then there occurs a laminar separation of flow on the right side of divider 32. The separation "bubble" decreases the angular deflection of flow on the right side of divider 32 and introduces further turbulence in the flow from port 48.

SUMMARY OF THE INVENTION

Accordingly, it is an object of our invention to provide a casting nozzle that improves the flow behavior associated with the introduction of liquid metal into a mold through a casting nozzle.

Another object is to provide a casting nozzle wherein the inertial force of the liquid metal flowing through the nozzle is divided and better controlled by dividing the flow into separate and independent streams within the bore of the nozzle in a multiple stage fashion.

A further object is to provide a casting nozzle that results in the alleviation of flow separation, and therefore the reduction of turbulence, stabilization of exit jets, and the achievement of a desired deflection angle for the independent streams.

It is also an object to provide a casting nozzle to diffuse or decelerate the flow of liquid metal traveling therethrough and therefore reduce the inertial force of the flow so as to stabilize the exit jets from the nozzle.

It is another object to provide a casting nozzle wherein deflection of the streams is accomplished in part by negative pressures applied to the outer portions of the streams, as by curved terminal bending sections, to render the velocity distribution in the outlet ports more uniform.

A further object is to provide a casting nozzle having a main transition from circular cross-section containing a flow of axial symmetry, to an elongated cross-section with a thickness which is less than the diameter of the circular cross-section and a width which is greater than the diameter of the circular cross-section containing a flow of planar symmetry with generally uniform velocity distribution throughout the transition neglecting wall friction.

A still further object is to provide a casting nozzle having a hexagonal cross-section of the main transition to increase the efficiency of flow deflections within the main transition.

A still further object is to provide a casting nozzle having diffusion between the inlet pipe and the outlet ports to decrease the velocity of flow from the ports and reduce turbulence.

A still further object is to provide a casting nozzle having diffusion or deceleration of the flow within the main transition of cross-section to decrease the velocity of the flow from the ports and improve the steadiness of velocity and uniformity of velocity of streamlines at the ports.

A still further object is to provide a casting nozzle having a flow divider provided with a rounded leading edge to permit variation in stagnation point without flow separation.

A still further object is to provide a casting nozzle which more effectively utilizes the available space within a bulged or crown-shaped mold and promotes an improved flow pattern therein.

A still further object is to provide a casting nozzle having a bore with a multi-faceted interior geometry which provides greater internal cross-sectional area for the bore near a central axis of the casting nozzle than at the edges.

A still further object is to provide a casting nozzle which achieves a wide useful range of operational flow throughputs without degrading flow characteristics.

A still further object is to provide a casting nozzle with baffles which proportion the flow divided between outer streams and a central stream so that the effective discharge angle of the outer streams exiting upper exit ports varies based on the throughput of liquid metal through the casting nozzle.

A still further object is to provide a casting nozzle with baffles which proportion the flow divided between outer streams and a central stream so that the effective discharge angle of the outer streams exiting upper exit ports increases as the throughput of liquid metal through the casting nozzle increases.

It has been found that the above and other objects of the present invention are attained in a method and apparatus for flowing liquid metal through a casting nozzle includes an elongated bore having at least one entry port, at least one upper exit port, and at least one lower exit port. A baffle is positioned proximate to the upper exit port to divide the flow of liquid metal through the bore into at least one outer stream and a central stream, the outer stream flowing through the upper exit port and the central stream flowing past the baffle and toward the lower exit port. The baffle is adapted to allocate the proportion of liquid metal divided between the outer stream and the central stream so that the effective discharge angle of the outer stream exiting through the upper exit port varies based on the flow throughput of liquid metal through the casting nozzle.

Preferably, the effective discharge angle of the outer streams increases as flow throughput increases.

In a preferred embodiment, the baffles are adapted so that about 15–45%, most preferably 25–40%, of the total flow of liquid through the casting nozzle is allocated to the outer streams and about 55–85%, most preferably 60–75%, of the total flow of liquid through the nozzle is allocated to the central stream.

In a preferred embodiment, the theoretical discharge angle of the upper exits ports is about 0–25°, and most preferably about 7–10°, downward from the horizontal.

The casting nozzle may also include a central axis and at least one entry port and at least one exit port, the bore of the casting nozzle including an enlarged portion to provide the bore with greater cross-sectional area near the central axis than near the edges of the bore.

In a preferred embodiment, the enlarged portion comprises at least two bending facets, each of which extends from a point on a plane which is substantially parallel to and intersects the central axis, toward a lower edge of the bore. In a preferred embodiment, the bending facets include a top edge and a central edge, and at least two of the top edges are adjacent to each other to form a pinnacle pointing generally toward the entry port. Preferably, the central edge of each bending facet is more distant from a lengthwise horizontal axis of the casting nozzle than the top edge of the bending facet within a horizontal cross-section.

It has been found that the above and other objects of the present invention are attained in a method and apparatus for flowing liquid metal through a casting nozzle that includes an elongated bore having an entry port and at least two exit ports. A first baffle is positioned proximate to one exit port and a second baffle is positioned proximate to the other exit port.

The baffles divide the flow of liquid metal into two outer streams and a central stream, and deflect the two outer streams in substantially opposite directions. A flow divider positioned downstream of the baffles divides the central stream into two inner streams, and cooperates with the baffles to deflect the two inner streams in substantially the same direction in which the two outer streams are deflected.

Preferably, the outer and inner streams recombine before or after the streams exit at least one of the exit ports.

In a preferred embodiment, the baffles deflect the outer streams at an angle of deflection of approximately 20–90° from the vertical. Preferably, the baffles deflect the outer streams at an angle of approximately 30° from the vertical.

In a preferred embodiment, the baffles deflect the two inner streams in a different direction from the direction in which the two outer streams are deflected. Preferably, the baffles deflect the two outer streams at an angle of approximately 45° from the vertical and deflect the two inner streams at an angle of approximately 30° from the vertical.

Other features and objects of our invention will become apparent from the following description of the invention which refers to the accompanying drawings.

BRIEF DESCRIPTION OF THE DRAWINGS

In the accompanying drawings which form part of the instant specification and which are to be read in conjunction therewith and in which like reference numerals are used to indicate like parts in the various views:

FIG. 1*a* is a fragmentary cross-section looking rearwardly of a preferred flow divider having a rounded leading edge.

FIG. 6*a* is an alternative cross-section taken in the plane 6—6 of FIGS. 1 and 2, looking downwardly.

FIG. 6*b* is a cross-section taken in the plane 6—6 of FIGS. 13 and 14 and of FIGS. 15 and 16, looking downwardly.

FIG. 7 is an axial sectional view looking rearwardly of a second casting nozzle having a constant area round-to-rectangular transition, a hexagonal small-angle diverging main transition with diffusion, and moderate terminal bending.

FIG. 8 is an axial sectional view looking to the right of the nozzle of FIG. 7.

FIG. 17*a* is a sectional view, looking rearwardly, showing the mold flow patterns produced by the nozzle of FIG. 17.

FIG. 17*b* is a cross-section in the curvilinear plane of the meniscus, looking downwardly, and showing the surface flow patterns produced by the nozzle of FIG. 17.

DESCRIPTION OF THE PREFERRED EMBODIMENTS

Figures 1, 2:
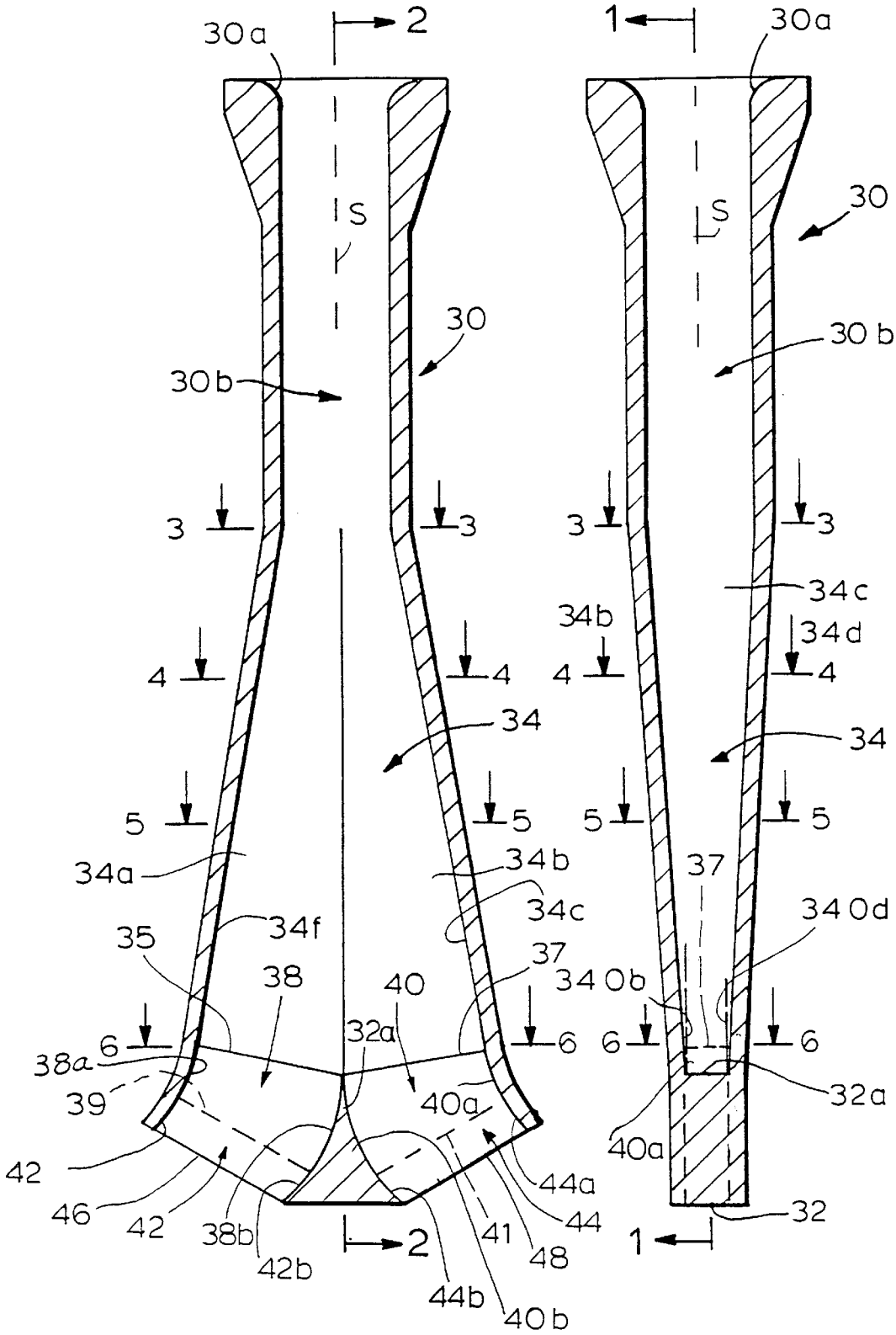
FIG. 1 is an axial sectional view looking rearwardly taken along the line 1—1 of FIG. 2 of a first casting nozzle having a hexagonal small-angle diverging main transition with diffusion, and moderate terminal bending.
FIG. 2 is an axial sectional view looking to the right taken along the line 2—2 of FIG. 1.
Figures 1B, 2A:
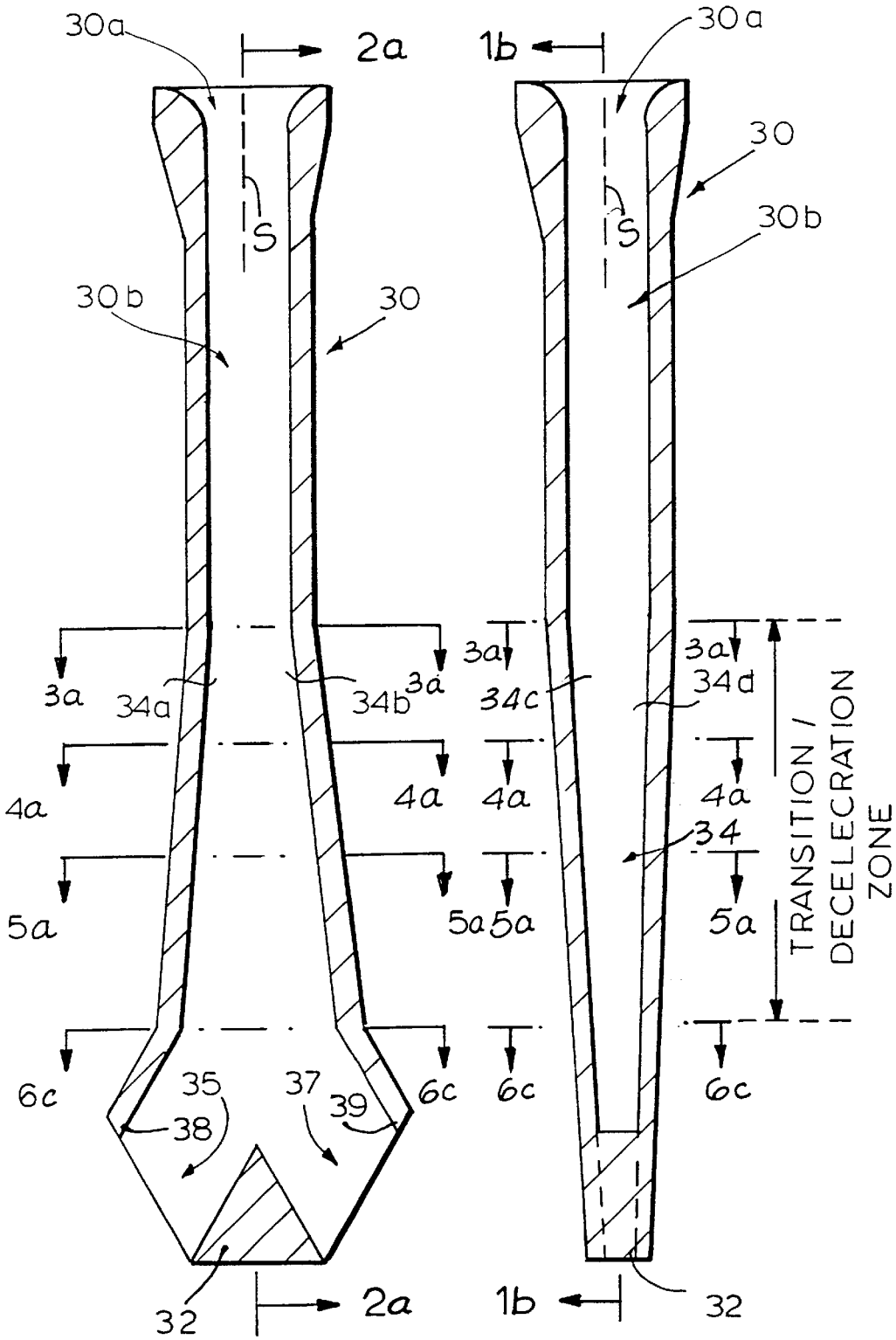
FIG. 1*b* is an alternate axial sectional view taken along the line 1*b*—1*b* of FIG. 2*b* of an alternate embodiment of a casting nozzle, having a main transition with deceleration and diffusion, and deflection of the outlet flows.
FIG. 2*a* is an axial sectional view taken along the line 2*a*—2*a* of FIG. 1*b*.
Figure 3:
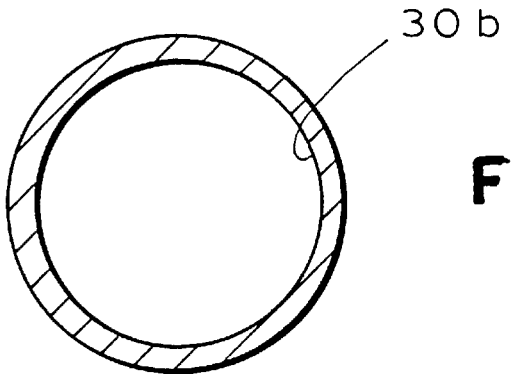
FIG. 3 is a cross-section taken in the plane 3—3 of FIGS. 1 and 2, looking downwardly.
Figure 3A:
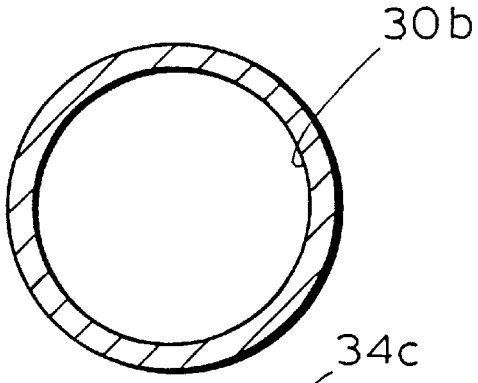
FIG. 3*a* is a cross-section taken in the plane 3*a*—3*a* of FIGS. 1*b* and 2*a*.

Referring now to FIGS. 1*b* and 2*a*, the casting nozzle is indicated generally by the reference numeral 30. The upper end of the nozzle includes an entry nozzle 30*a* terminating in a circular pipe or bore 30*b* which extends downwardly, as shown in FIGS. 1*b* and 2*a*. The axis of pipe section 30*b* is considered as the axis S of the nozzle. Pipe section 30*b* terminates at the plane 3*a*—3*a* which, as can be seen from FIG. 3*a*, is of circular cross-section. The flow then enters the main transition indicated generally by the reference numeral 34 and preferably having four walls 34*a* through 34*d*. Side walls 34*a* and 34*b* each diverge at an angle from the vertical. Front walls 34*c* and 34*d* converge with rear walls 34*a* and 34*b*. It should be realized by those skilled in the art that the transition area 34 can be of any shape or cross-sectional area of planar symmetry and need not be limited to a shape having the number of walls (four of six walls) or cross-sectional areas set forth herein just so long as the transition area 34 changes from a generally round cross-sectional area to a generally elongated cross-sectional area of planar symmetry, see FIGS. 3*a*, 4*a*, 5*a*, 6*c*.

For a conical two-dimensional diffuser, it is customary to limit the included angle of the cone to approximately 8° to avoid undue pressure loss due to incipient separation of flow. Correspondingly, for a one-dimensional rectangular diffuser, wherein one pair of opposed walls are parallel, the other pair of opposed walls should diverge at an included angle of not more than 16°; that is, plus 8° from the axis for one wall and minus 8° from the axis for the opposite wall. For example, in the diffusing main transition 34 of FIG. 1*b*, a 2.65° mean convergence of the front walls and a 5.2° divergence of side walls yields an equivalent one-dimensional divergence of the side walls of 10.4–5.3=5.1°, approximately, which is less than the 8° limit.

Figure 4:
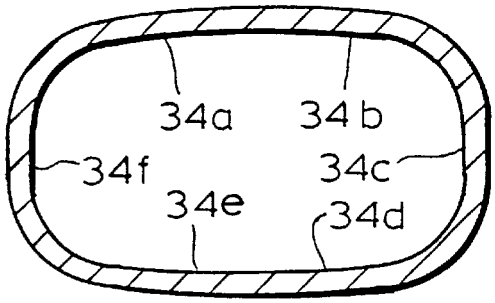
FIG. 4 is a cross-section taken in the plane 4—4 of FIGS. 1 and 2, looking downwardly.
Figure 5:
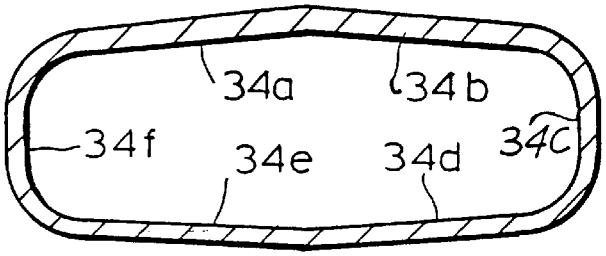
FIG. 5 is a cross-section taken in the plane 5—5 of FIGS. 1 and 2, looking downwardly.
Figure 6:
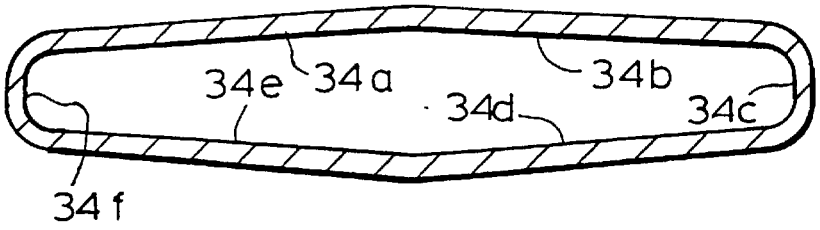
FIG. 6 is a cross-section taken in the plane 6—6 of FIGS. 1 and 2, looking downwardly.
Figure 4A:
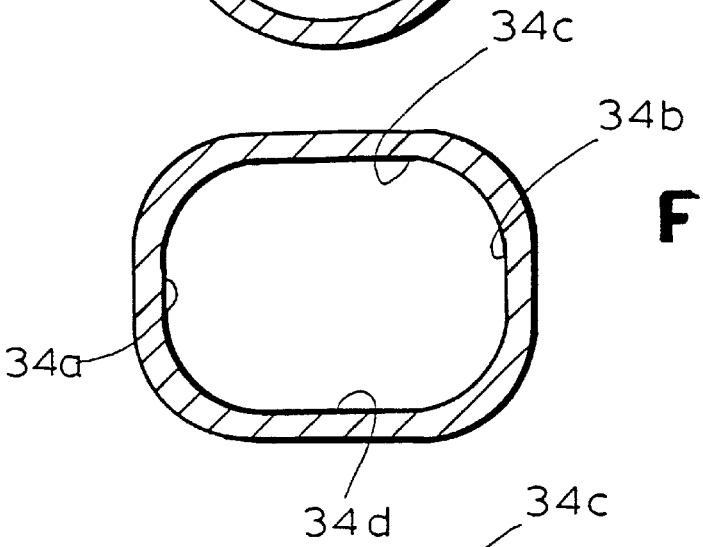
FIG. 4*a* is a cross-section taken in the plane 4*a*—4*a* of FIGS. 1*b* and 2*a*.
Figure 5A:
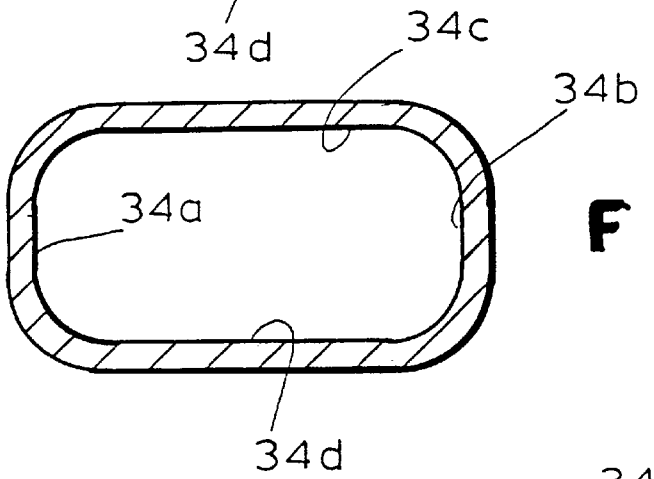
FIG. 5*a* is a cross-section taken in the plane 5*a*—5*a* of FIGS. 1*b* and 2*a*.
Figure 6C:
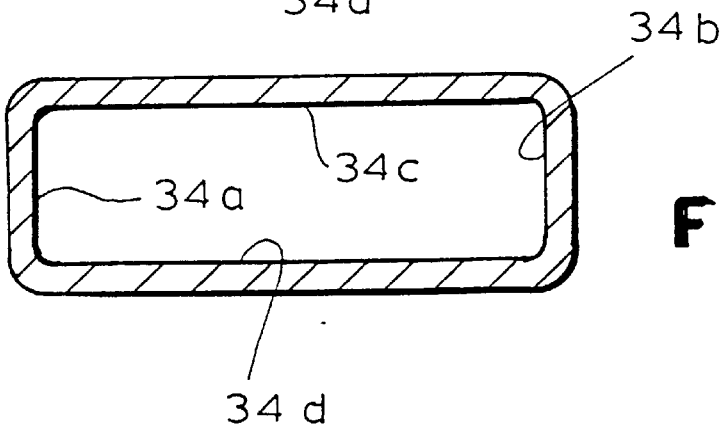
FIG. 6*c* is a cross-section taken in the 6*a*—6*a* of FIGS. 1*b* and 2*a*.

FIGS. 4*a*, 5*a* and 6*c* are cross-sections taken in the respective planes 4*a*—4*a*, 5*a*—5*a* and 6*c*—6*c* of FIGS. 1*b* and 2*a*, which are respectively disposed below plane 3*a*—3*a*. FIG. 4*a* shows four salient comers of large radius; FIG. 5*a* shows four salient comers of medium radius; and FIG. 6*c* shows four salient comers of small radius.

The flow divider 32 is disposed below the transition and there is thus created two axis 35 and 37. The included angle of the flow divider is generally equivalent to the divergence angle of the exit walls 38 and 39.

The area in plane 3*a*—3*a* is greater than the area of the two angled exits 35 and 37; and the flow from exits 35 and 37 has a lesser velocity than the flow in circular pipe section 30*b*. This reduction in the mean velocity of flow reduces turbulence occasioned by liquid from the nozzle entering the mold.

The total deflection is the sum of that produced within main transition 34 and that provided by the divergence of the exit walls 38 and 39. It has been found that a total deflection angle of approximately 30° is nearly optimum for the continuous casting of thin steel slabs having widths in the range from 975 to 1625 mm or 38 to 64 inches, and thicknesses in the range of 50 to 60 mm. The optimum deflection angle is dependent on the width of the slab and to some extent upon the length, width and depth of the mold bulge B. Typically the bulge may have a length of 800 to 1100 mm, a width of 150 to 200 mm and a depth of 700 to 800 mm.

Referring now to FIGS. 1 and 2, an alternative casting nozzle is indicated generally by the reference numeral 30. The upper end of the nozzle includes an entry nozzle 30*a* terminating in a circular pipe 30*b* of 76 mm inside diameter which extends downwardly, as shown in FIGS. 1 and 2. The axis of pipe section 30*b* is considered as the axis S of the nozzle. Pipe section 30*b* terminates at the plane 3—3 which, as can be seen from FIG. 3, is of circular cross-section and has an area of 4536 $mm^2$. The flow then enters the main transition indicated generally by the reference numeral 34 and preferably having six walls 34*a* through 34*f*. Side walls 34*c* and 34*f* each diverge at an angle, preferably an angle of 10° from the vertical. Front walls 34*d* and 34*e* are disposed at small angles relative to one another as are rear walls 34*a* and 34*b*. This is explained in detail subsequently. Front walls 34*d* and 34*e* converge with rear walls 34*a* and 34*b*, each at a mean angle of roughly 3.8° from the vertical.

For a conical two-dimensional diffuser, it is customary to limit the included angle of the cone to approximately 8° to avoid undue pressure loss due to incipient separation of flow. Correspondingly, for a one-dimensional rectangular diffuser, wherein one pair of opposed walls are parallel, the other pair of opposed walls should diverge at an included angle of not more than 16°; that is, plus 8° from the axis for one wall and minus 8° from the axis for the opposite wall. In the diffusing main transition 34 of FIG. 1, the 3.8° mean convergence of the front and rear walls yields an equivalent one-dimensional divergence of the side walls of 10–3.8=6.2°, approximately, which is less than the 8° limit.

FIGS. 4, 5 and 6 are cross-sections taken in the respective planes 4—4, 5—5 and 6—6 of FIGS. 1 and 2, which are respectively disposed 100, 200 and 351.6 mm below plane 3—3. The included angle between front walls 34*e* and 34*d* is somewhat less than 180° as is the included angle between rear walls 34*a* and 34*b*. FIG. 4 shows four salient corners of large radius; FIG. 5 shows four salient corners of medium radius; and FIG. 6 shows four salient comers of small radius. The intersection of rear walls 34*a* and 34*b* may be provided with a filet or radius, as may the intersection of front walls 34*d* and 34*e*. The length of the flow passage is 111.3 mm in FIG. 4, 146.5 mm in FIG. 5, and 200 mm in FIG. 6.

Alternatively, as shown in FIG. 6*a*, the cross-section in plane 6—6 may have four salient corners of substantially zero radius. The front walls 34*e* and 34*d* and the rear walls

34*a* and 34*b* along their lines of intersection extend downwardly 17.6 mm below plane 6—6 to the tip 32*a* of flow divider 32. There is thus created two exits 35 and 37 respectively disposed at plus and minus 10° angles relative to the horizontal. Assuming that transition 34 has sharp salient corners in plane 6—6, as shown in FIG. 6*a*, each of the angled exits would be rectangular, having a slant length of 101.5 mm and a width of 28.4 mm, yielding a total area of 5776 mm .

The ratio of the area in plane 3—3 to the area of the two angled exits 35 and 37 is $\pi/4=0.785$; and the flow from exits 35 and 37 has 78.5% of the velocity in circular pipe section 30*b*. This reduction in the mean velocity of flow reduces turbulence occasioned by liquid from the nozzle entering the mold. The flow from exits 35 and 37 enters respective curved rectangular pipe sections 38 and 40. It will subsequently be shown that the flow in main transition 34 is substantially divided into two streams with higher fluid velocities adjacent side walls 34*c* and 34*f* and lower velocities adjacent the axis. This implies a bending of the flow in two opposite directions in main transition 34 approaching plus and minus 10°. The curved rectangular pipes 38 and 40 bend the flows through further angles of 20°. The curved sections terminate at lines 39 and 41. Downstream are respective straight rectangular pipe sections 42 and 44 which nearly equalize the velocity distribution issuing from the bending sections 38 and 40. Ports 46 and 48 are the exits of respective straight sections 42 and 44. It is desirable that the inner walls 38*a* and 40*a* of respective bending sections 38 and 40 have an appreciable radius of curvature, preferably not much less than half that of outer walls 38*b* and 40*b*. The inner walls 38*a* and 40*a* may have a radius of 100 mm; and outer walls 38*b* and 40*b* would have a radius of 201.5 mm. Walls 387*b* and 40*b* are defined by flow divider 32 which has a sharp leading edge with an included angle of 20°. Divider 32 also defines walls 42*b* and 44*b* of the straight rectangular sections 42 and 44.

Figure 17:
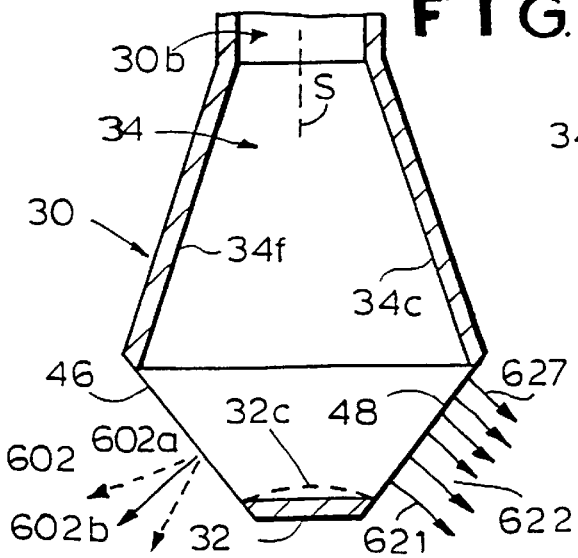
FIG. 17 is an axial sectional view looking rearwardly of a prior art nozzle.
Figure 18:
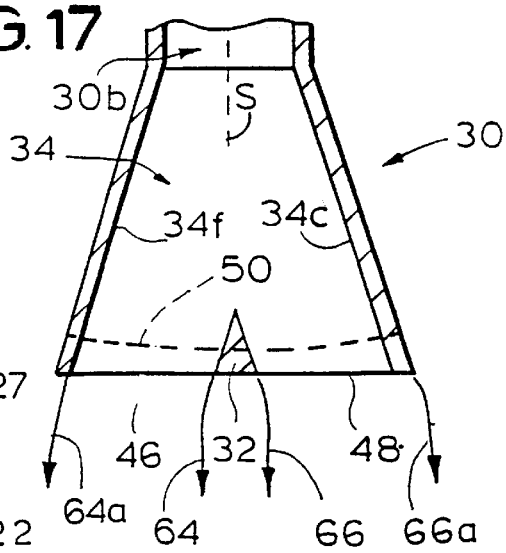
FIG. 18 is an axial sectional view looking rearwardly of a further prior art nozzle.
Figure 19:
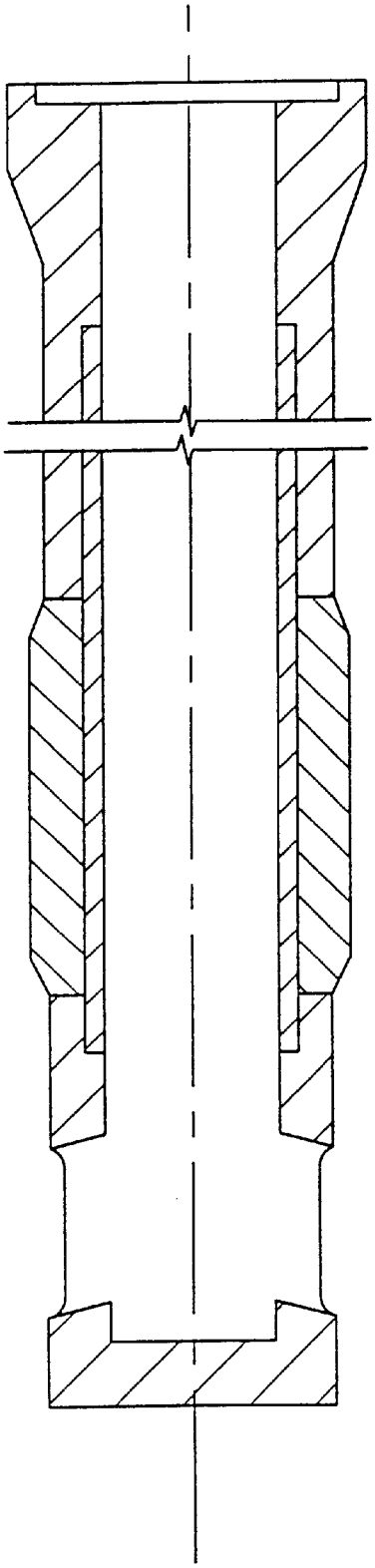
FIG. 19 PRIOR ART
FIG. 19 is an axial sectional view of another prior art nozzle.
Figure 20:
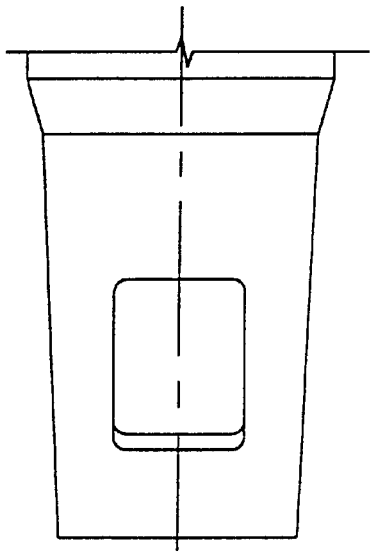
FIG. 20 PRIOR ART
FIG. 20 is a partial side sectional view of the prior art nozzle of FIG. 19.
Figure 21:
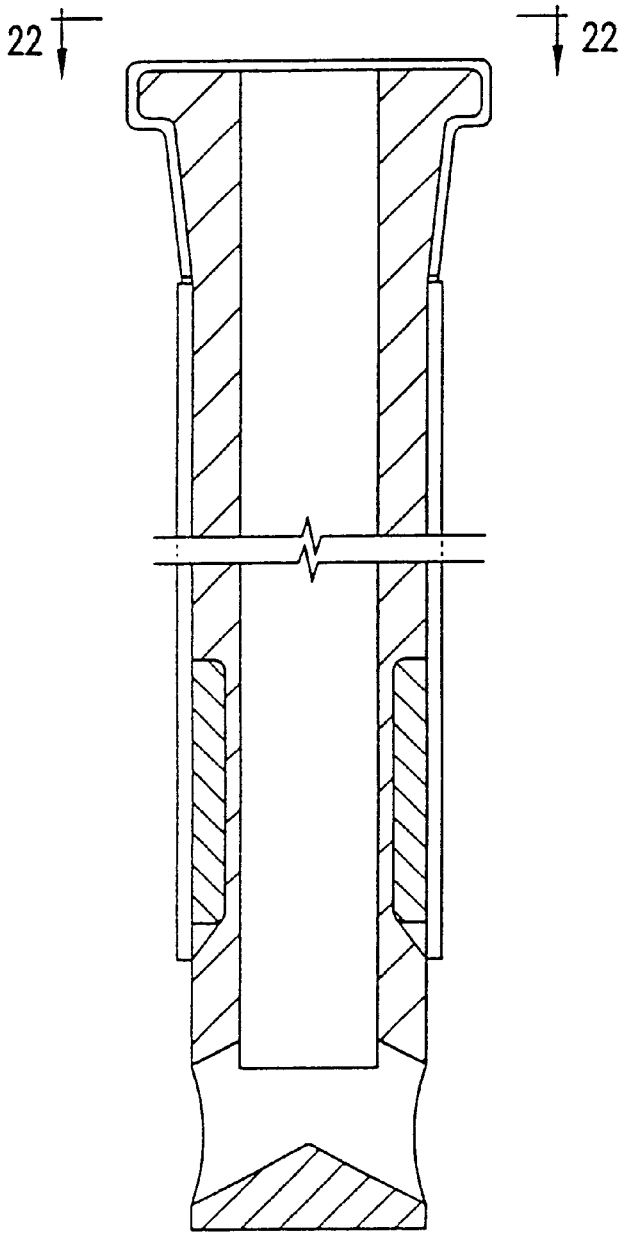
FIG. 21 PRIOR ART
FIG. 21 is an axial sectional view of another prior art nozzle.
Figure 22:
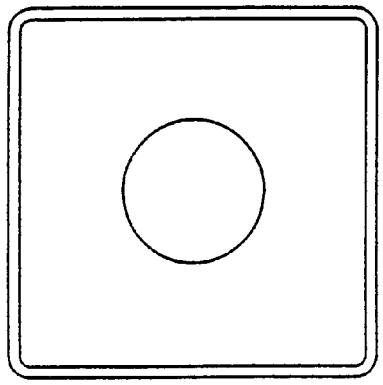
FIG. 22 PRIOR ART
FIG. 22 is top plan view on arrow A of the prior art nozzle of FIG. 21.
Figure 23:
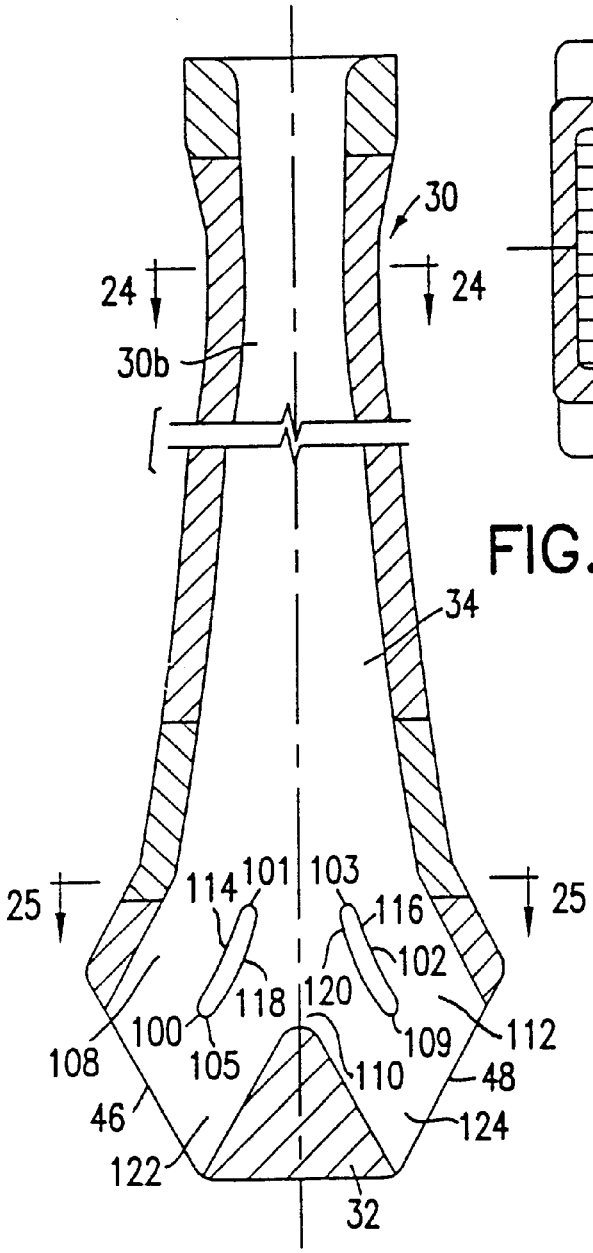
FIG. 23 shows an axial sectional view of an alternative embodiment of a casting nozzle of the present invention.
Figure 25:
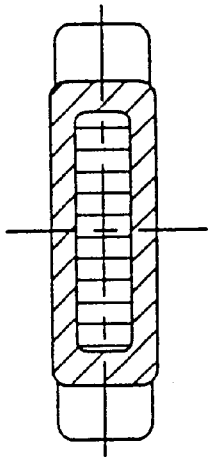
FIG. 25 shows a cross-sectional view of FIG. 23 taken across line B—B of FIG. 23.
Figure 27:
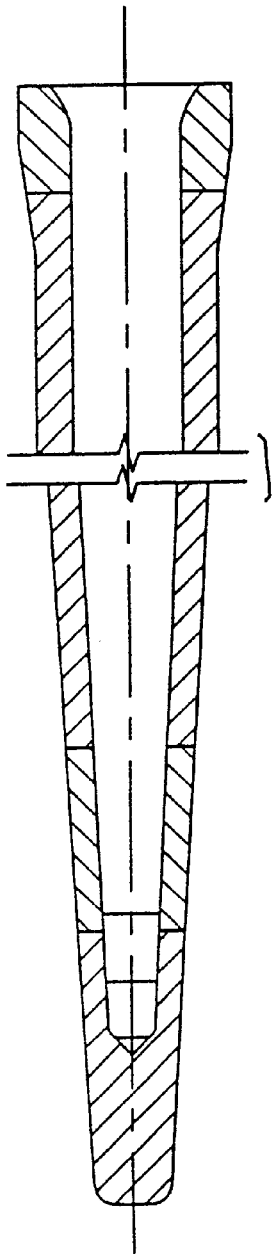
FIG. 27 shows a side axial sectional view of the casting nozzle of FIG. 23.
Figure 24:
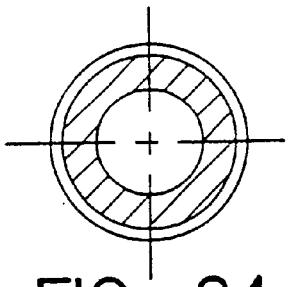
FIG. 24 shows a cross-sectional view of FIG. 23 taken across line A—A of FIG. 23.
Figure 26:
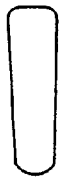
FIG. 26 shows a partial side axial sectional view of the casting nozzle of FIG. 23.

It will be understood that adjacent inner walls 38*a* and 40*a* there is a low pressure and hence high velocity whereas adjacent outer walls 387*b* and 40*b* there is a high pressure and hence low velocity. It is to be noted that this velocity profile in curved sections 38 and 40 is opposite to that of the prior art nozzles of FIGS. 17 and 18. Straight sections 42 and 44 permit the high-velocity low-pressure flow adjacent inner walls 38*a* and 40*a* of bending sections 38 and 40 a reasonable distance along walls 42*a* and 44*a* within which to diffuse to lower velocity and higher pressure.

The total deflection is plus and minus 30° comprising 10° produced within main transition 34 and 20° provided by the curved pipe sections 38 and 40. It has been found that this total deflection angle is nearly optimum for the continuous casting of steel slabs having widths in the range from 975 to 1625 mm or 38 to 64 inches. The optimum deflection angle is dependent on the width of the slab and to some extent upon the length, width and depth of the mold bulge B. Typically the bulge may have a length of 800 to 1100 mm, a width of 150 to 200 mm and a depth of 700 to 800 mm. Of course it will be understood that where the section in plane 6—6 is as shown in FIG. 6, pipe sections 38, 40, 42 and 44 would no longer be perfectly rectangular but would be only generally so. It will be further appreciated that in FIG. 6, side walls 34*c* and 34*f* may be substantially semicircular with no straight portion. The intersection of rear walls 34*a* and 34*b* has been shown as being very sharp, as along a line, to improve the clarity of the drawings. In FIG. 2, 340*b* and 340*d* represent the intersection of side wall 34*c* with respective front and rear walls 34*b* and 34*d*, assuming square salient comers as in FIG. 6*a*. However, due to rounding of the four salient comers upstream of plane 6—6, lines 340*b* and 340*d* disappear. Rear walls 34*a* and 34*b* are oppositely twisted relative to one another, the twist being zero in plane 3—3 and the twist being nearly maximum in plane 6—6. Front walls 34*d* and 34*e* are similarly twisted. Walls 38*a* and 42*a* and walls 40*a* and 44*a* may be considered as flared extensions of corresponding side walls 34*f* and 34*c* of the main transition 34.

Referring now to FIG. la, there is shown on an enlarged scale a flow divider 32 provided with a rounded leading edge. Curved walls 387*b* and 40*b* are each provided with a radius reduced by 5 mm, for example, from 201.5 to 196.5 mm. This produces, in the example, a thickness of over 10 mm within which to fashion a rounded leading edge of sufficient radius of curvature to accommodate the desired range of stagnation points without producing laminar separation. The tip 32*b* of divider 32 may be semi-elliptical, with vertical semi-major axis. Preferably tip 32*b* has the contour of an airfoil such, for example, as an NACA 0024 symmetrical wing section ahead of the 30% chord position of maximum thickness. Correspondingly, the width of exits 35 and 37 may be increased by 1.5 mm to 29.9 mm to maintain an exit area of 5776 $mm^2$.

Referring now to FIGS. 7 and 8, the upper portion of the circular pipe section 30*b* of the nozzle has been shown broken away. At plane 3—3 the section is circular. Plane 16—16 is 50 mm below plane 3—3. The cross-section is rectangular, 76 mm long and 59.7 mm wide so that the total area is again 4536 $mm^2$. The circular-to-rectangular transition 52 between planes 3—3 and 16—16 can be relatively short because no diffusion of flow occurs. Transition 52 is connected to a 25 mm height of rectangular pipe 54, terminating at plane 17—17, to stabilize the flow from transition 52 before entering the diffusing main transition 34, which is now entirely rectangular. The main transition 34 again has a height of 351.6 mm between planes 17—17 and 6—6 where the cross-section may be perfectly hexagonal, as shown in FIG. 6*a*. The side walls 34*c* and 34*f* diverge at an angle of 10° from the vertical, and the front walls and rear walls converge at a mean angle, in this case, of approximately 2.6° from the vertical. The equivalent one-dimensional diffuser wall angle is now 10–2.6=7.4°, approximately, which is still less than the generally used 8° maximum. The rectangular pipe section 54 may be omitted, if desired, so that transition 52 is directly coupled to main transition 34. In plane 6—6 the length is again 200 mm and the width adjacent walls 34*c* and 34*f* is again 28.4 mm. At the centerline of the nozzle the width is somewhat greater. The cross-sections in planes 4—4 and 5—5 are similar to those shown in FIGS. 4 and 5 except that the four salient comers are sharp instead of rounded. The rear walls 34*a* and 34*b* and the front walls 34*d* and 34*e* intersect along lines which meet the tip 32*a* of flow divider 32 at a point 17.6 mm below plane 6—6. Angled rectangular exits 35 and 37 again each have a slant length of 101.5 mm and a width of 28.4 mm yielding a total exit area of 5776 $mm^2$. The twisting of front wall 34*b* and rear wall 34*d* is clearly seen in FIG. 8.

In FIGS. 7 and 8, as in FIGS. 1 and 2, the flows from exits 35 and 37 of transition 34 pass through respective rectangular turning sections 38 and 40, where the respective flows are turned through an additional 20° relative to the vertical, and then through respective straight rectangular equalizing sections 42 and 44. The flows from sections 42 and 44 again have total deflections of plus and minus 30° from the vertical. The leading edge of flow divider 32 again has an included angle of 20°. Again it is preferable that the flow divider 32 has a rounded leading edge and a tip (32*b*) which is semi-elliptical or of airfoil contour as in FIG. 1*a*.

Figure 9:
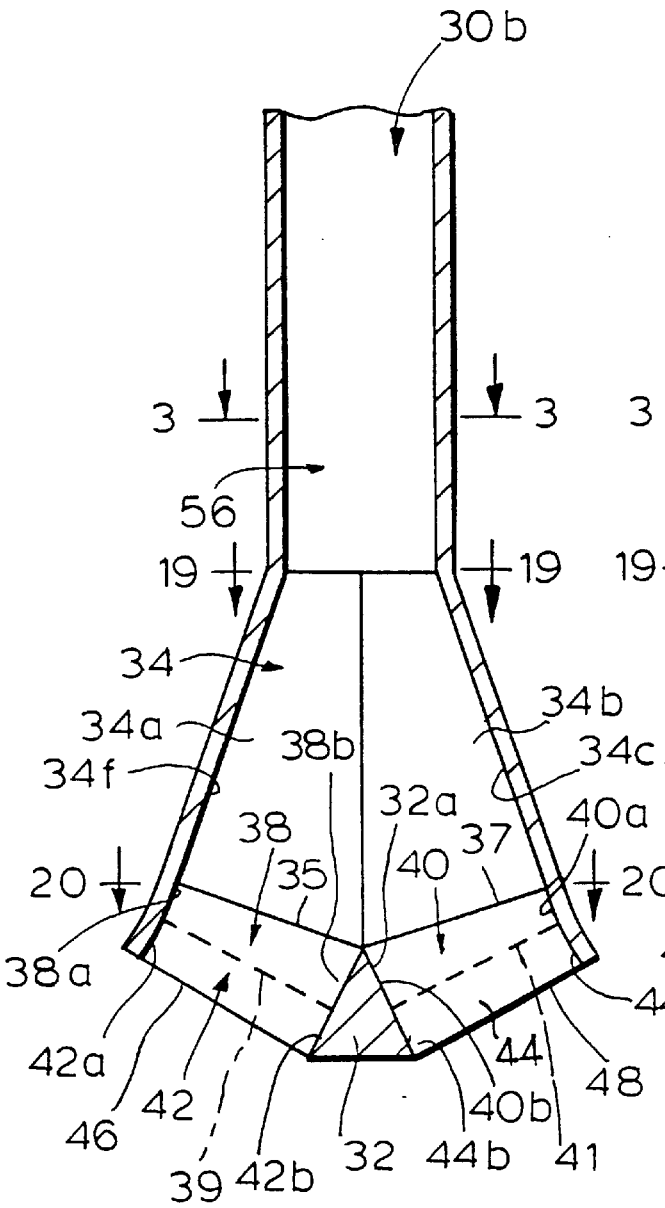
FIG. 9 is an axial sectional view looking rearwardly of a third casting nozzle having a round-to-square transition with moderate diffusion, a hexagonal medium-angle diverging main transition with constant flow area, and low terminal bending.
Figure 10:
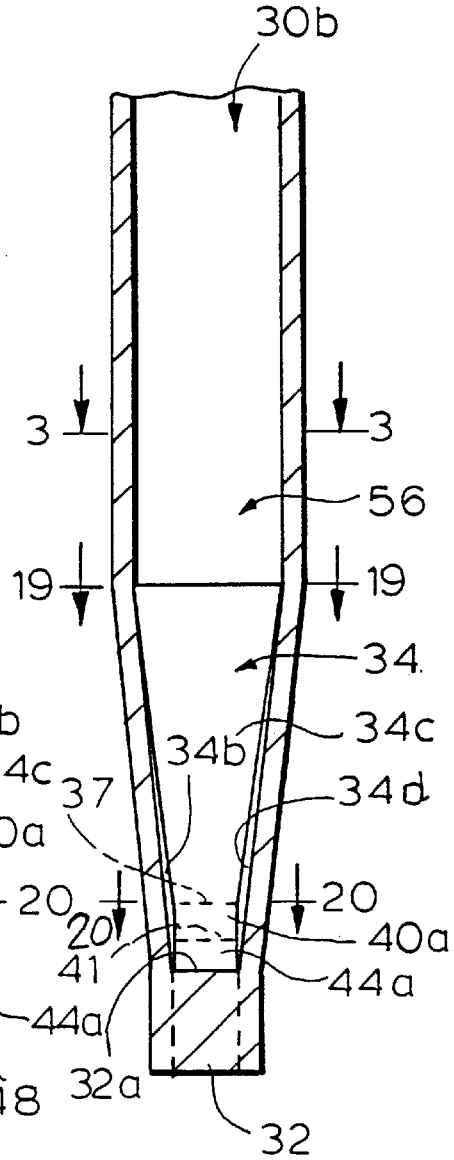
FIG. 10 is an axial sectional view looking to the right of the nozzle of FIG. 9.

Referring now to FIGS. 9 and 10, between planes 3—3 and 19—19 is a circular-to-square transition 56 with diffusion. The area in plane 19—19 is $76^2$=5776 $mm^2$. The distance between planes 3—3 and 19—19 is 75 mm; which is equivalent to a conical diffuser where the wall makes an angle of 3.5° to the axis and the total included angle between walls is 7.0°. Side walls 34*c* and 34*f* of transition 34 each diverge at an angle of 20° from the vertical while rear walls 34*a*–34*b* and front walls 34*d*–34*e* converge in such a manner as to provide a pair of rectangular exit ports 35 and 37 disposed at 20° angles relative to the horizontal. Plane 20—20 lies 156.6 mm below plane 19—19. In this plane the length between walls 34*c* and 34*f* is 190 mm. The lines of intersection of the rear walls 34*a*–34*b* and of the front walls 34*d*–34*e* extend 34.6 mm below plane 20—20 to the tip 32*a* of divider 32. The two angled rectangular exit ports 35 and 37 each have a slant length of 101.1 mm and a width of 28.6 mm yielding an exit area of 5776 $mm^2$ which is the same as the entrance area of the transition in plane 19—19. There is no net diffusion within transition 34. At exits 35 and 37 are disposed rectangular turning sections 38 and 40 which, in this case, deflect each of the flows only through an additional 10°. The leading edge of flow divider 32 has an included angle of 40°. Turning sections 38 and 40 are followed by respective straight rectangular sections 42 and 44. Again, the inner walls 38*a* and 40*a* of sections 38 and 40 may have a radius of 100 mm which is nearly half of the 201.1 mm radius of the outer walls 387*b* and 40*b*. The total deflection is again plus and minus 30°. Preferably flow divider 32 is provided with a rounded leading edge and a tip (32*b*) which is semi-elliptical or of airfoil contour by reducing the radii of walls 387*b* and 40*b* and, if desired, correspondingly increasing the width of exits 35 and 37.

Figure 11:
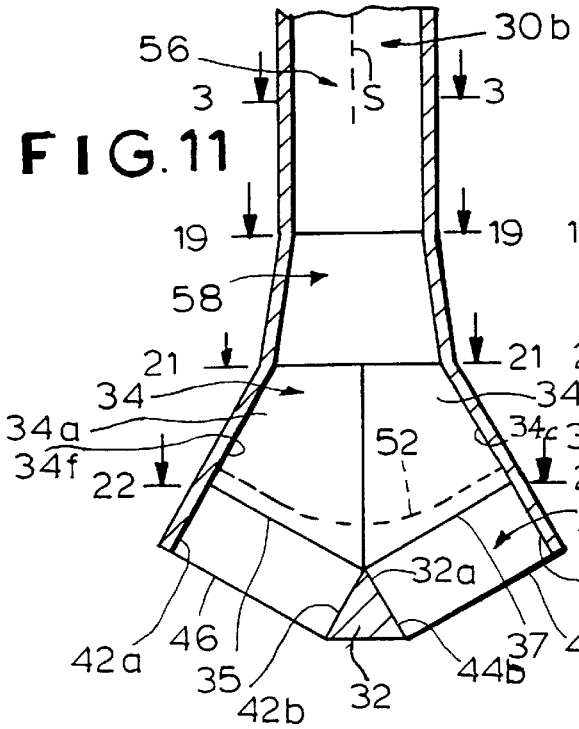
FIG. 11 is an axial sectional view looking rearwardly of a fourth casting nozzle providing round-to-square and square-to-rectangular transitions of high total diffusion, a hexagonal high-angle diverging main transition with decreasing flow area, and no terminal bending.
Figure 12:
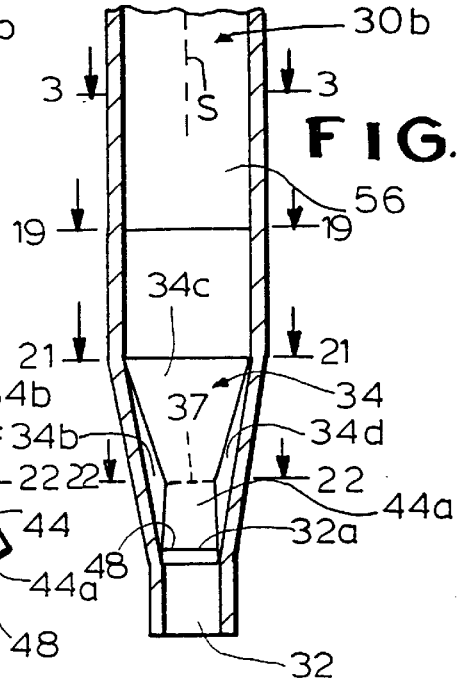
FIG. 12 is an axial sectional view looking to the right of the nozzle of FIG. 11.

Referring now to FIGS. 11 and 12, in plane 3—3 the cross-section is again circular; and in plane 19—19 the cross-section is square. Between planes 3—3 and 19—19 is a circular-to-square transition 56 with diffusion. Again, separation in the diffuser 56 is obviated by making the distance between planes 3—3 and 19—19 75 mm. Again the area in plane 19—19 is $76^2$=5776 $mm^2$. Between plane 19—19 and plane 21—21 is a one-dimensional square-to-rectangular diffuser. In plane 21—21 the length is $(4/\pi)76$= 96.8 mm and the width is 76 mm, yielding an area of 7354 $mm^2$. The height of diffuser 58 is also 75 mm; and its side walls diverge at 7.5° angles from the vertical. In main transition 34, the divergence of each of side walls 34*c* and 34*f* is now 30° from the vertical. To ensure against flow separation with such large angles, transition 34 provides a favorable pressure gradient wherein the area of exit ports 35 and 37 is less than in the entrance plane 21—21. In plane 22—22, which lies 67.8 mm below plane 21—21, the length between walls 34*c* and 34*f* is 175 mm. Angled exit ports 35 and 37 each have a slant length of 101.0 mm and a width of 28.6 mm, yielding an exit area of 5776 $mm^2$. The lines of intersection of rear walls 34*a*–34*b* and front walls 34*d*–34*e* extend 50.5 mm below plane 22—22 to the tip 32*a* of divider 32. At the exits 35 and 37 of transition 34 are disposed two straight rectangular sections 42 and 44. Sections 42 and 44 are appreciably elongated to recover losses of deflection within transition 34. There are no intervening turning sections 38 and 40; and the deflection is again nearly plus and minus 300 as provided by main transition 34. Flow divider 32 is a triangular wedge having a leading edge included angle of 60°. Preferably divider 32 is provided with a rounded leading edge and a tip (32*b*) which is of semi-elliptical or airfoil contour, by moving walls 42*a* and 42*b* outwardly and thus increasing the length of the base of divider 32. The pressure rise in diffuser 58 is, neglecting friction, equal to the pressure drop which occurs in main transition 34. By increasing the width of exits 35 and 37, the flow velocity can be further reduced while still achieving a favorable pressure gradient in transition 34.

In FIG. 11, 52 represents an equipotential of flow near exits 35 and 37 of main transition 34. It will be noted that equipotential 52 extends orthogonally to walls 34*c* and 34*f*, and here the curvature is zero. As equipotential 52 approaches the center of transition 34, the curvature becomes greater and greater and is maximum at the center of transition 34, corresponding to axis S. The hexagonal cross-section of the transition thus provides a turning of the flow streamlines within transition 34 itself. It is believed the mean deflection efficiency of a hexagonal main transition is more than ⅔ and perhaps ¾ or 75% of the apparent deflection produced by the side walls.

In FIGS. 1–2 and 7–8 the 2.5 loss from 10° in the main transition is almost fully recovered in the bending and straight sections. In FIGS. 9–10 the 5° loss from 20° in the main transition is nearly recovered in the bending and straight sections. In FIGS. 11–12 the 7.5° loss from 30° in the main transition is mostly recovered in the elongated straight sections.

Figure 13:
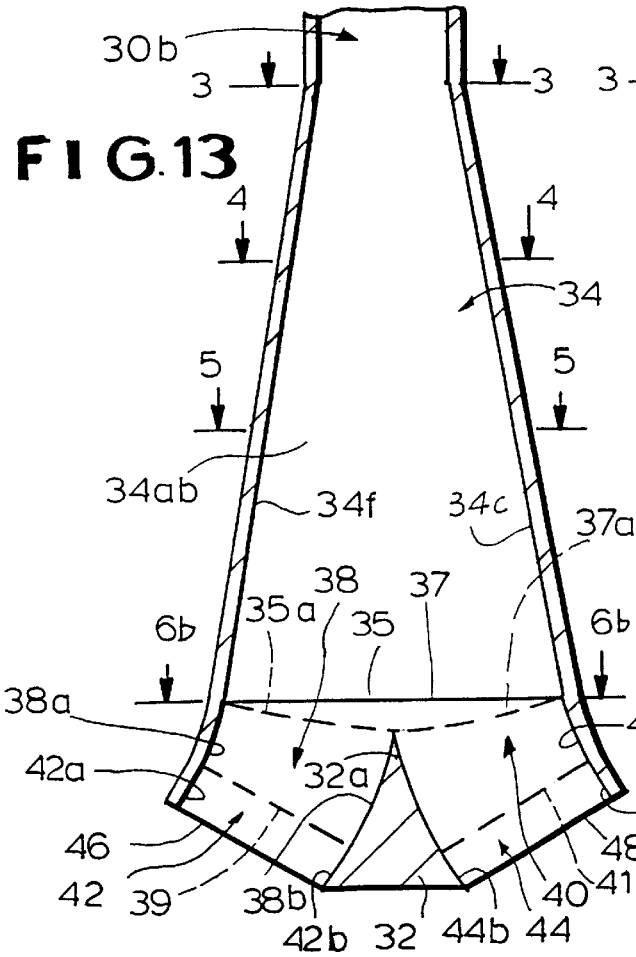
FIG. 13 is an axial sectional view looking rearwardly of a fifth casting nozzle similar to that of FIG. 1 but having a rectangular main transition.
Figure 14:
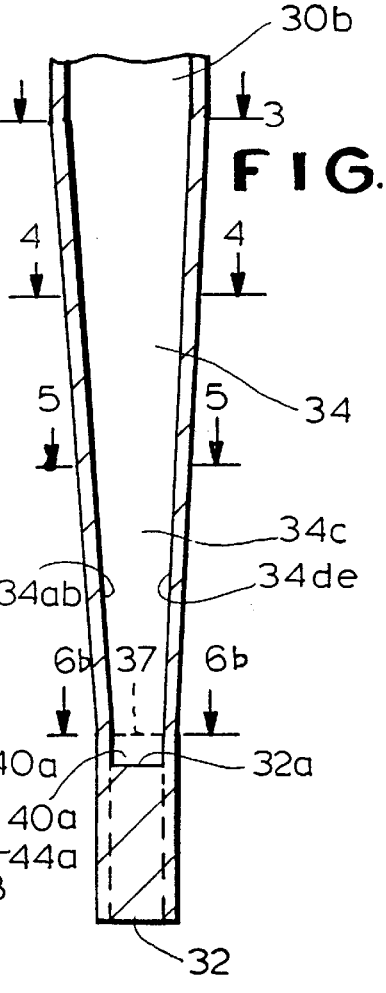
FIG. 14 is an axial sectional view looking to the right of the nozzle of FIG. 13.

Referring now to FIGS. 13 and 14, there is shown a variant of FIGS. 1 and 2 wherein the main transition 34 is provided with only four walls, the rear wall being 34*ab* and the front wall being 34*de*. The cross-section in plane 6—6 may be generally rectangular as shown in FIG. 6*b*. Alternatively, the cross-section may have sharp corners of zero radius. Alternatively, the side walls 34*c* and 34*f* may be of semi-circular cross-section with no straight portion, as shown in FIG. 17*b*. The cross-sections in planes 4—4 and 5—5 are generally as shown in FIGS. 4 and 5 except, of course, rear walls 34*a* and 34*b* are collinear as well as front walls 34*e* and 34*d*. Exits 35 and 37 both lie in plane 6—6. The line 35*a* represents the angled entrance to turning section 38; and the line 37*a* represents the angled entrance to turning section 40. Flow divider 32 has a sharp leading edge with an included angle of 20°. The deflections of flow in the left-hand and right-hand portions of transition 34 are perhaps 20% of the 10° angles of side walls 34*c* and 34*f*, or mean deflections of plus and minus 2°. The angled entrances 35*a* and 37*a* of turning sections 38 and 40 assume that the flow has been deflected 10° within transition 34. Turning sections 38 and 40 as well as the following straight sections 42 and 44 will recover most of the 8° loss of deflection within transition 34; but it is not to be expected that the deflections from ports 46 and 48 will be as great as plus and minus 30°. Divider 32 preferably has a rounded leading edge and a tip (32*b*) which is semi-elliptical or of airfoil contour as in FIG. 1*a*.

Figure 15:
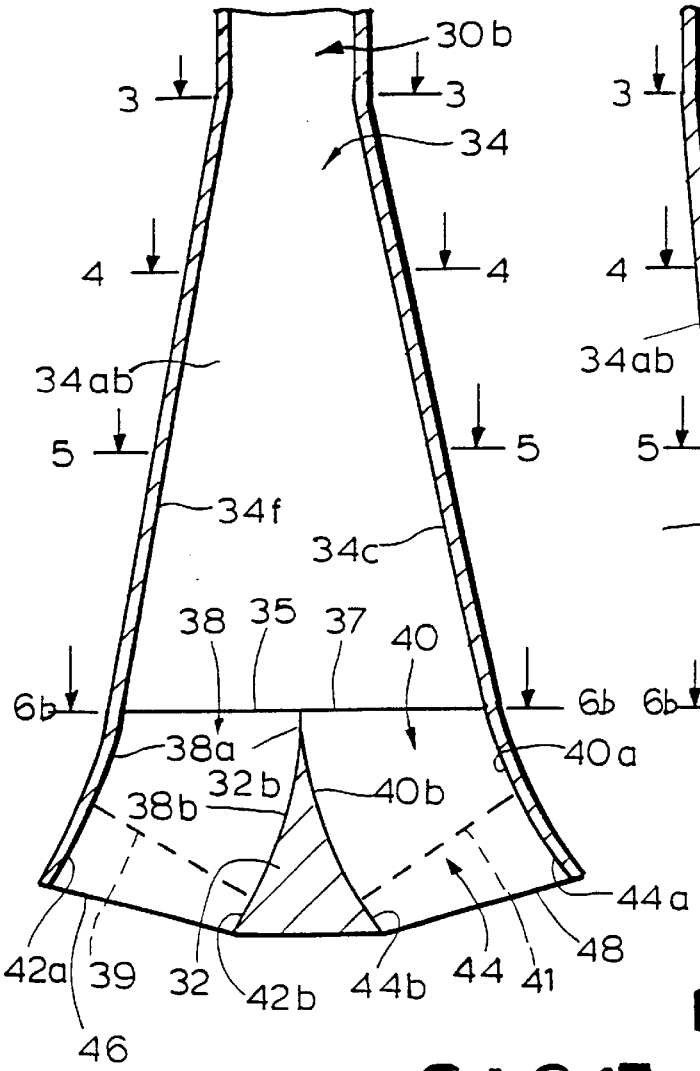
FIG. 15 is an axial sectional view looking rearwardly of a sixth casting nozzle having a rectangular small-angle diverging main transition with diffusion, minor flow deflection within the main transition, and high terminal bending.
Figure 16:
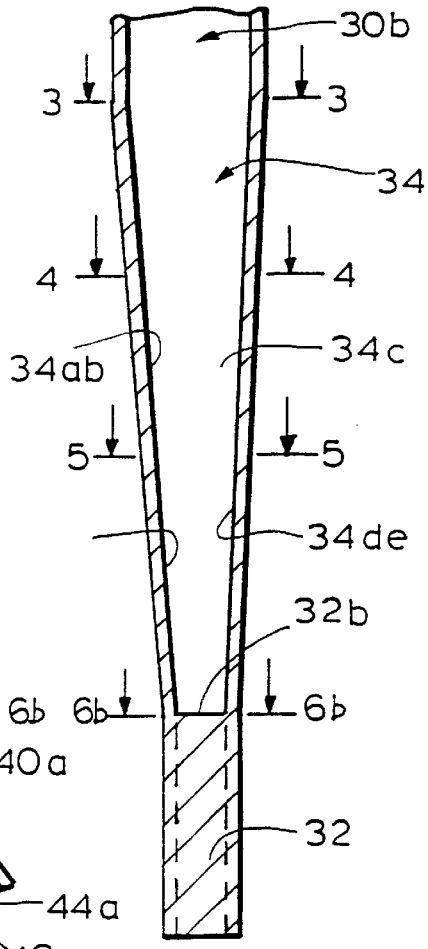
FIG. 16 is an axial sectional view looking to the right of the nozzle of FIG. 15.

Referring now to FIGS. 15 and 16, there is shown a further nozzle similar to that shown in FIGS. 1 and 2. Transition 34 again has only four walls, the rear wall being 34*ab* and the front wall being 34*de*. The cross-section in plane 6—6 may have rounded corners as shown in FIG. 6*b* or may alternatively be rectangular with sharp corners. The cross-sections in planes 4—4 and 5—5 are generally as shown in FIGS. 4 and 5 except rear walls 34*a*–34*b* are collinear as are front walls 34*d*–34*e*. Exits 35 and 37 both lie in plane 6—6. In this embodiment of the invention, the deflection angles at exits 35–37 are assumed to be 0°. Turning sections 38 and 40 each deflect their respective flows through 30°. In this case, if flow divider 32 were to have a sharp leading edge, it would be in the nature of a cusp with an included angle of 0°, which construction would be impractical. Accordingly, walls 38*b* and 40*b* have a reduced radius so that the leading edge of the flow divider 32 is rounded and the tip (32*b*) is semi-elliptical or preferably of airfoil contour. The total deflection is plus and minus 30° as provided solely by turning sections 38 and 40. Outlet ports 46 and 48 of straight sections 42 and 44 are disposed at an angle from the horizontal of less than 30°, which is the flow deflection from the vertical.

Walls 42*a* and 44*a* are appreciably longer than walls 42*b* and 44*b*. Since the pressure gradient adjacent walls 42*a* and 44*a* is unfavorable, a greater length is provided for diffusion. The straight sections 42 and 44 of FIGS. 15–16 may be used in FIGS. 1–2, 7–8, 9–10, and 13–14. Such straight sections may also be used in FIGS. 11–12; but the benefit would not be as great. It will be noted that for the initial one-third of turning sections 38 and 40 walls 38*a* and 40*a* provide less apparent deflection than corresponding side walls 34*f* and 34*c*. However, downstream of this, flared walls 38*a* and 40*a* and flared walls 42*a* and 44*a* provide more apparent deflection than corresponding side walls 34*f* and 34*c*.

In an initial design similar to FIGS. 13 and 14 which was built and successfully tested, side walls 34*c* and 34*f* each had a divergence angle of 5.2° from the vertical; and rear wall 34*ab* and front wall 34*de* each converged at an angle of 2.65° from the vertical. In plane 3—3, the flow cross-section was circular with a diameter of 76 mm. In plane 4—4, the flow cross-section was 95.5 mm long and 66.5 mm wide with radii of 28.5 mm for the four comers. In plane 5—5 the cross-section was 115 mm long and 57.5 mm wide with radii of 19 mm for the comers. In plane 6—6, which was disposed 150 mm, instead of 151.6 mm, below plane 5—5, the cross-section was 144 mm long and 43.5 mm wide with radii of 5 mm for the comers; and the flow area was 6243 $mm^2$. Turning sections 38 and 40 were omitted. Walls 42*a* and 44*a* of straight sections 40 and 42 intersected respective side walls 34*f* and 34*c* in plane 6—6. Walls 42 and 44*a* again diverged at 30° from the vertical and were extended downwardly 95 mm below plane 6—6 to a seventh horizontal plane. The sharp leading edge of a triangular flow divider 32 having an included angle of 60° (as in FIG. 11) was disposed in this seventh plane. The base of the divider extended 110 mm below the seventh plane. The outlet ports 46 and 48 each had a slant length of 110 mm. It was found that the tops of ports 46 and 48 should be submerged at least 150 mm below the meniscus. At a casting rate of 3.3 tons per minute with a slab width of 1384 mm, the height of standing waves was only 7 to 12 mm; no surface vortices formed in the meniscus; no oscillation was evident for mold widths less than 1200 mm; and for mold width greater than this, the resulting oscillation was minimal. It is believed that this minimal oscillation for large mold widths may result from flow separation on walls 42*a* and 44*a*, because of the extremely abrupt terminal deflection, and because of flow separation downstream of the sharp leading edge of flow divider 32. In this initial design, the 2.65° convergence of the front and rear walls 34*ab* and 34*de* was continued in the elongated straight sections 42 and 44. Thus these sections were not rectangular with 5 mm radius comers but were instead slightly trapezoidal, the top of outlet ports 46 and 48 had a width of 35 mm and the bottom of outlet ports 46 and 48 had a width of 24.5 mm. We consider that a section which is slightly trapezoidal is generally rectangular.

Referring now to FIGS. 23–29, there is shown alternative embodiments of the present invention. These casting nozzles are similar to the casting nozzles of the present invention, but include baffles 100–106 to incorporate multiple stages of flow division into separate streams with independent deflection of these streams within the interior of the nozzle. It should be realized, however, by those skilled in the art that the baffles do not have to be used with the nozzles of the present invention, but can be used with any of the known or prior art casting or submerged entry nozzles just so long as the baffles 100–106 are used to incorporate multiple stages of flow division into separate streams with independent deflection of these streams within the interior of the nozzle.

With respect to FIGS. 23–27, there is shown a casting nozzle 30 of the present invention, e.g., a casting nozzle having a transition section 34 where there is a transition from axial symmetry to planar symmetry within this section so as to diffuse or decelerate the flow and therefore reduce the inertial force of the flow exiting the nozzle 30. After the metal flow proceeds along the transition section 34, it encounters baffles 100, 102 which are located within or inside the nozzle 30. Preferably, the baffles should be positioned so that the upper edges 101, 103 of the baffles 100, 102, respectively, are upstream of the exit ports 46, 48. The lower edges 105, 107 of the baffles 100, 102, respectively, may or may not be positioned upstream of the exit ports 46, 48, although it is preferred that the lower edges 105, 107 are positioned upstream of the exit ports 46, 48.

The baffles 100, 102 function to diffuse the liquid metal flowing through the nozzle 30 in multiple stages. The baffles first divide the flow into three separate streams 108, 110 and 112. The streams 108, 112 are considered the outer streams and the stream 114 is considered a central stream. The baffles 100, 102 include upper faces 114, 116, respectively, and lower faces 118, 120, respectively. The baffles 100, 102 cause the two outer streams 108, 112 to be independently deflected in opposite directions by the upper faces 114, 116 of the baffles. The baffles 100, 102 should be constructed and arranged to provide an angle of deflection of approximately 20–90°, preferably, 30°, from the vertical. The central stream 114 is diffused by the diverging lower faces 118, 120 of the baffles. The central stream 114 is subsequently divided by the flow divider 32 into two inner streams 122, 124 which are oppositely deflected at angles matching the angles that the outer streams 108, 112 are deflected, e.g., 20–90°, preferably 30°, from the vertical.

Because the two inner streams 122, 124 are oppositely deflected at angles matching the angles that the outer streams 108, 112 are deflected, the outer streams 108, 112 are then recombined with the inner streams 122, 124, respectively, i.e., its matching stream, within the nozzle 30 before the streams of molten metal exit the nozzle 30 and are released into a mold.

The outer streams 108, 112 recombine with the inner streams 122, 124, respectively, within the nozzle 30 for an addition reason. The additional reason is that if the lower edges 105, 107 of the baffles 100, 102, are upstream of the exit ports 46, 48, i.e., do not fully extend to the exit ports 46, 48, the outer streams 108, 112 are no longer being physically separated from the inner streams 122, 124 before the streams exit the nozzle 30.

Figure 29:
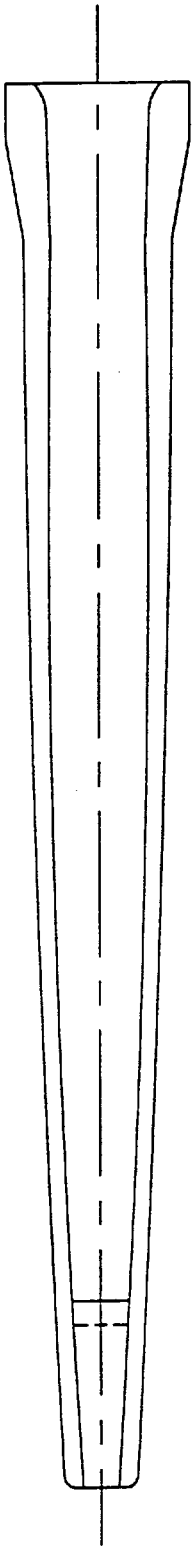
FIG. 29 shows a side axial sectional view of the casting nozzle of FIG. 28.
Figure 28:
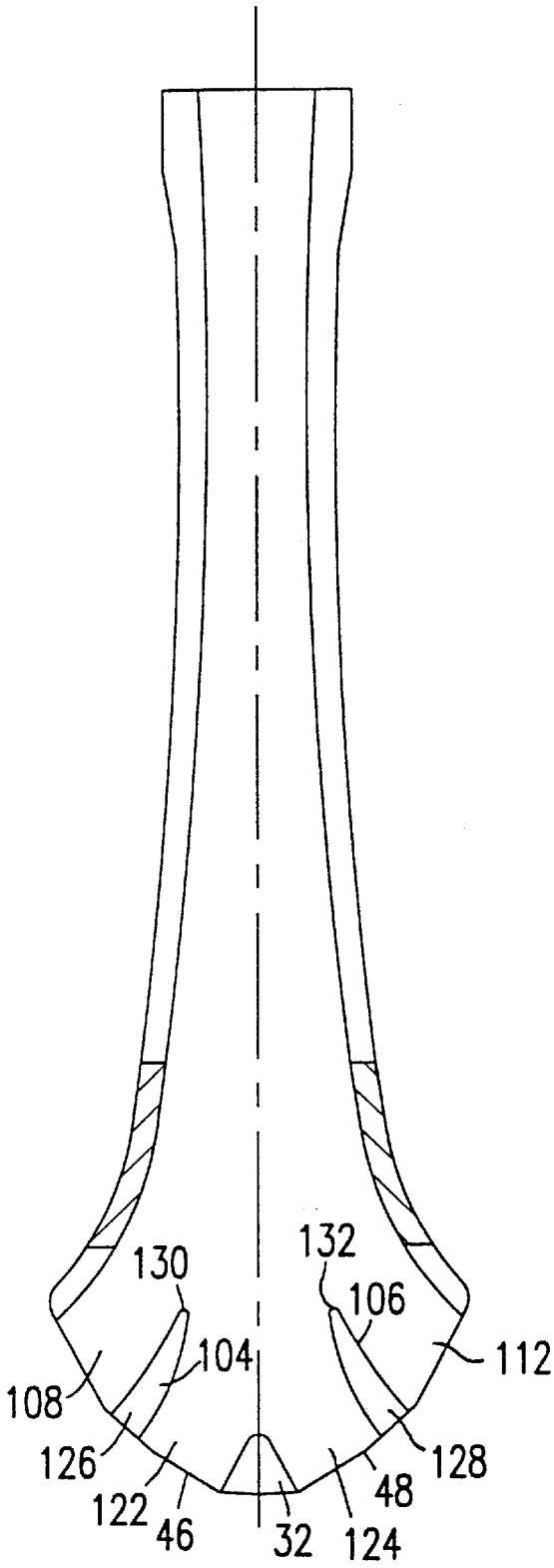
FIG. 28 shows an axial sectional view of an alternative embodiment of a casting nozzle of the present invention.

FIGS. 28–29 show an alternative embodiment of the casting nozzle 30 of the present invention. In this embodiment, the upper edges 130, 132, but not the lower edges 126, 128, of the baffles 104, 106 are positioned upstream of the exit ports 46, 48. This completely separates the outer streams 108, 112 and the inner streams 122, 124 within the nozzle 30. Moreover, in this embodiment, the deflection angles of the outer streams 108, 112 and the inner streams 122, 124 do not match. As a result, the outer streams 108, 112 and the inner streams 122, 124 do not recombine within the nozzle 30.

Preferably, the baffles 104, 106 and the flow divider 32 are constructed and arranged so that the outer streams 108, 112 are deflected about 45° from the vertical, and the inner streams 122, 124 are deflected about 30° from the vertical. Depending on the desired mold flow distribution, this embodiment allows independent adjustment of the deflection angles of the outer and inner streams.

Figure 31:
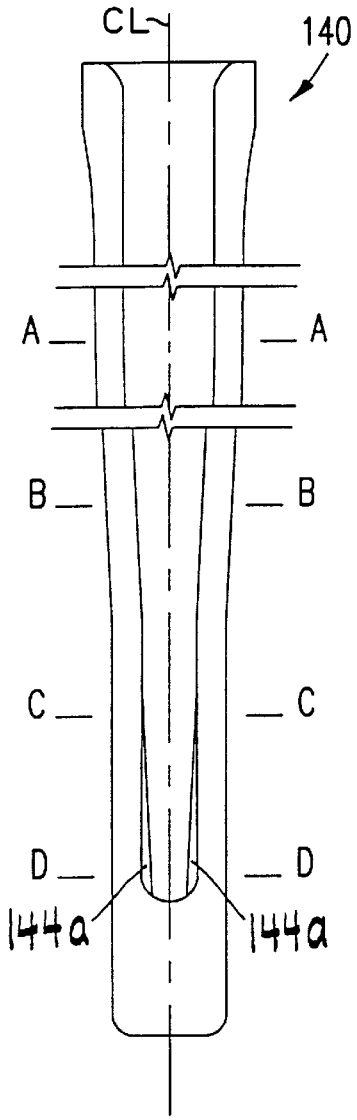
FIG. 31 shows a side axial sectional view of the casting nozzle of FIG. 30.
Figure 30:
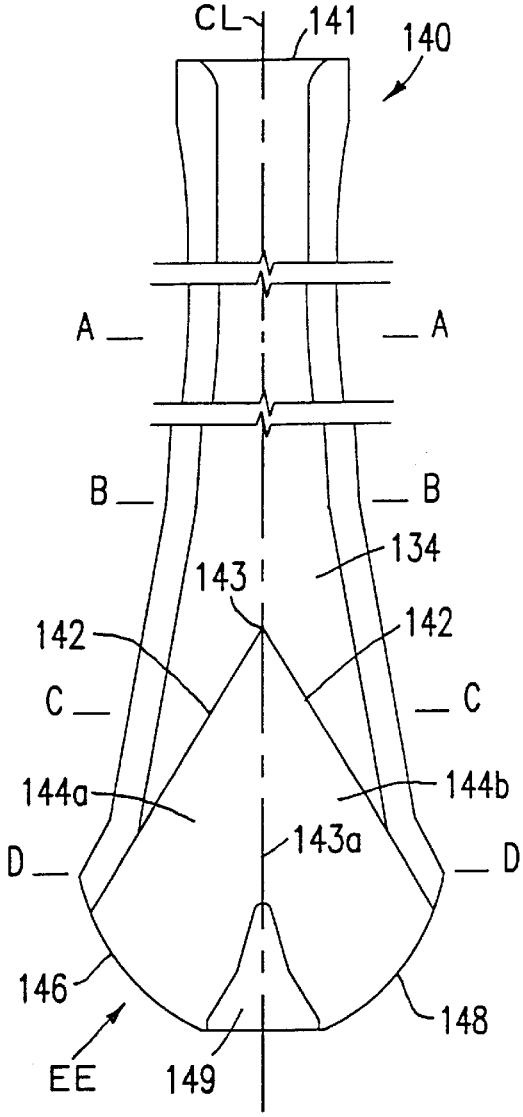
FIG. 30 shows an axial sectional view of an alternative embodiment of a casting nozzle of the present invention.
Figure 30A:
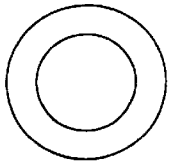
FIG. 30A shows a cross-sectional view of FIG. 30 taken across line A—A of FIG. 30.

Referring now to FIGS. 30 and 31, there is shown another alternative embodiment of the present invention. A bifurcated casting nozzle 140 is provided which has two exit ports 146, 148 and is similar to other casting nozzle embodiments of the present invention. The casting nozzle 140 of FIGS. 30 and 31, however, includes a faceted or "diamond-back" internal geometry giving the nozzle greater internal cross-sectional area at the central axis or center line CL of the nozzle than at the edges of the nozzle.

Near the bottom or exit end of the transition section 134 of casting nozzle 140, two angled, adjacent edges 142 extend downward from the center of each of the interior broad faces of casting nozzle 140 toward the tops of the exit ports 146 and 148. Edges 142 preferably form a pinnacle 143 between sections B—B and C—C pointing upwards towards entry port 141, and comprise the top edges of interior bending facets 144*a* and 144*b*. These bending facets 144*a* and 144*b* comprise the diamond-back internal geometry of nozzle 140. They converge at a central edge 143*a* and taper outward toward the exit ports 146, 148 from central edge 143*a*.

Top edges 142 preferably generally match the discharge angle of exit ports 146 and 148, thereby, promoting flow deflection or bending of the liquid metal flow to the theoretical discharge angle of exit ports 146 and 148. The discharge angle of exit ports 146 and 148 should be about 45–80° downward from the horizontal. Preferably, the discharge angle should be about 60° downward from the horizontal.

Figure 30C:
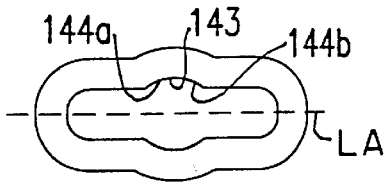
FIG. 30C shows a cross-sectional view of FIG. 30 taken across line C—C of FIG. 30.
Figure 30B:
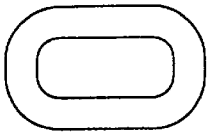
FIG. 30B shows a cross-sectional view of FIG. 30 taken across line B—B of FIG. 30.

Matching the top edges 142 to the discharge angle of exit ports 146 and 148 minimizes flow separation at the top of the exit ports and minimizes separation from the sidewall edges as the flow approaches the exit ports. Moreover, as most clearly seen in FIGS. 30, 30C and 30D, bending facets 144*a* and 144*b* are more distant from a lengthwise axis LA at a central edge 143*a* than at the top edge 142 within the same horizontal cross-section. As a result, greater internal cross-sectional area is provided near the central axis of the casting nozzle than at the edges.

Figure 30E:
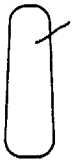
FIG. 30EE is a partial plan view of an exit port of the casting nozzle of FIG. 30 looking along arrow EE.
Figure 30D:
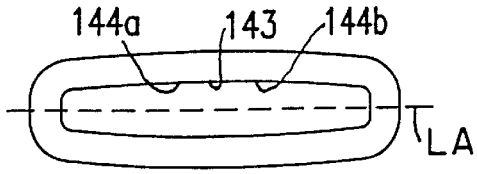
FIG. 30D shows a cross-sectional view of FIG. 30 taken across line D—D of FIG. 30.

As shown in FIG. 30EE, the diamond-back interior geometry causes exit ports 146 and 148 to be wider at the bottom of the port than at the top, i.e., wider near a flow divider 149, if present. As a result, the diamond-back port configuration more naturally matches the dynamic pressure distribution of the flow within the nozzle 140 in the region of the exit ports 146 and 148 and thereby produces more stable exit jets.

Figure 33:
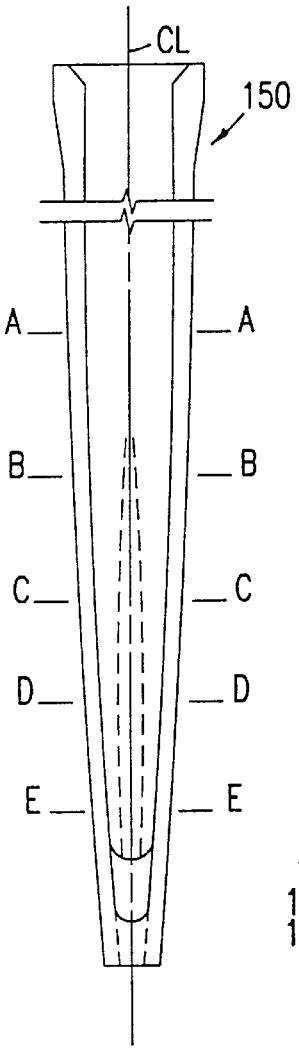
FIG. 33 shows a side axial sectional view of the casting nozzle of FIG. 32.
Figure 32:
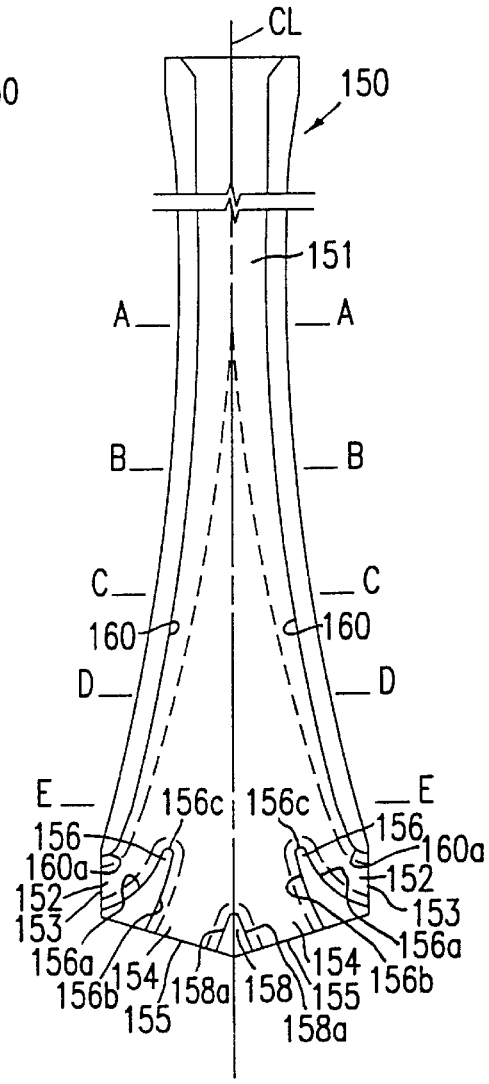
FIG. 32 shows an axial sectional view of an alternative embodiment of a casting nozzle of the present invention.
Figure 32A:
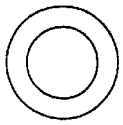
FIG. 32A shows a cross-sectional view of FIG. 32 taken across line A—A of FIG. 32.
Figure 32B:
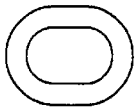
FIG. 32B shows a cross-sectional view of FIG. 32 taken across line B—B of FIG. 32.
Figure 32C:
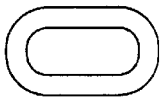
FIG. 32C shows a cross-sectional view of FIG. 32 taken across line C—C of FIG. 32.
Figure 32D:
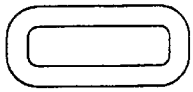
FIG. 32D shows a cross-sectional view of FIG. 32 taken across line D—D of FIG. 32.

Referring now to FIGS. 32–34, there is shown another alternative embodiment of the present invention. The casting nozzle 150 of FIGS. 32–34 is similar to other casting nozzle embodiments of the present invention. Casting nozzle 150, however, is configured to proportion the amount of flow that is distributed between upper and lower exit ports 153 and 155, respectively, and produce varying effective discharge angles of upper exit jets which exit upper exit ports 153 depending on the throughput flow of liquid metal through the casting nozzle 150.

As shown in FIGS. 32 and 33, casting nozzle 150 preferably incorporates multiple stages of flow division as described in the casting nozzle embodiments of the present invention set forth above. Casting nozzle 150 includes baffles 156 which, in conjunction with the lower faces 160*a* of sidewalls 160 and top faces 156*a* of baffles 156, define upper exit channels 152 which lead to upper exit ports 153.

Casting nozzle 150 may optionally include a lower flow divider 158 positioned substantially along the center line CL of casting nozzle 150 and downstream of baffles 156 in the direction of flow through the nozzle. With lower flow divider 158, bottom faces 156*b* of baffles 156 and top faces 158*a* of lower flow divider 158 would then define lower exit channels 154 which lead to lower exit ports 155.

Sidewalls 160, baffles 156 and flow divider 158 are preferably configured so that the theoretical discharge angle of the upper exit ports diverges from the theoretical discharge angle of the upper exit ports by at least about 15°. Preferably, sidewalls 160 and baffles 156 provide upper exit ports 153 having a theoretical discharge angle of about 0–25°, most preferably about 7–10°, downward from the horizontal. Baffles 156 and lower flow divider 158 preferably provide lower exit ports 155 having a theoretical discharge angle of about 45–80°, most preferably about 60–70°, downward from the horizontal.

If casting nozzle 150 does not include flow divider 158, casting nozzle 150 would then only include one lower exit port 155, not shown, defined by bottom faces 156*b* of baffles 156. Lower exit port 155 would then have a theoretical discharge angle of about 45–90°.

Referring now to FIGS. 32–34, in practice, baffles 156 initially divide the flow of liquid metal through the bore 151 into three separate streams: namely, two outer streams and one central stream. The two outer streams are deflected by the upper exit ports 153 to the theoretical discharge angle of about 0–25° downward from the horizontal and in opposite directions from the center line CL. These outer streams are discharged from the upper exit ports 153 as upper exit jets into the mold.

Meanwhile, the central stream proceeds downward through bore 151 and between the baffles 156. This central stream is further divided by the lower flow divider 158 into two inner streams which are oppositely deflected from the center line CL of the nozzle 150 in accordance with the curvature of the bottom faces 156*b* of the baffles 156 and the top faces 158*a* of the lower flow divider 158.

The curvature or shape of the top faces 156*a* of the baffles 156 or the shape of the baffles 156 themselves should be sufficient to guide the two outer streams to the theoretical discharge angle of the upper exit ports 153 of about 0–25° from the horizontal, although about 7–10° is preferred. Moreover, the configuration or shape of sidewall lower faces 160*a* and baffles 156 including the curvature or slope of the top faces 156*a* should be sufficient to keep substantially constant the cross-sectional area of the upper exit channels 152 to upper exit ports 153.

The curvature or shape of the bottom faces 156*b* of the baffles 156 and the top faces 158*a* of the flow divider 158 should be sufficient to guide the two inner streams to the theoretical discharge angle of the lower exit ports 155 of about 45–80° downward from the horizontal, although about 60–70° is preferred. This significantly diverges from the preferred theoretical discharge angle of about 7–10° of the upper exit port 153.

Figure 32E:
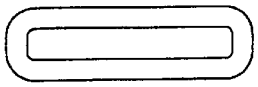
FIG. 32E shows a cross-sectional view of FIG. 32 taken across line E—E of FIG. 32.

The location of leading edges 156*c* of the baffles 156 in relation to the cross-section of the casting nozzle bore immediately above the leading edges 156*c*, e.g., FIG. 32E, determines the theoretical proportion of the flow which is divided between the outer streams and the central stream. Preferably, baffles 156 are located to produce a symmetric division of the flow (i.e. equivalent flow in each of the outer streams through the upper exit ports 153).

Preferably, a larger proportion of the total flow is allocated to the central stream than to the outer streams. In particular, it is advantageous to construct casting nozzle 150 and position the leading edges 156*c* of baffles 156 in relation to the cross-section of the casting nozzle bore immediately above the leading edge 156*c* so that about 15–45%, preferably about 25–40%, of the total flow through the casting nozzle 150 is associated with the two outer streams of the upper exit ports 153, and the remaining 55–85%, preferably about 60–75%, of the total flow is associated with the central stream which is discharged as the two inner streams through the lower exit ports 155 (or one central stream through lower exit port 155 if the casting nozzle 150 does not include lower flow divider 158). Proportioning the flow between the upper and lower exit ports 153 and 155 so that the lower exit ports 155 have a larger proportion of flow than the upper exit ports 153, as described above, also causes the effective discharge angle of the flow exiting the upper exit ports 153 to be influenced by the total flow throughput.

Figure 34A:
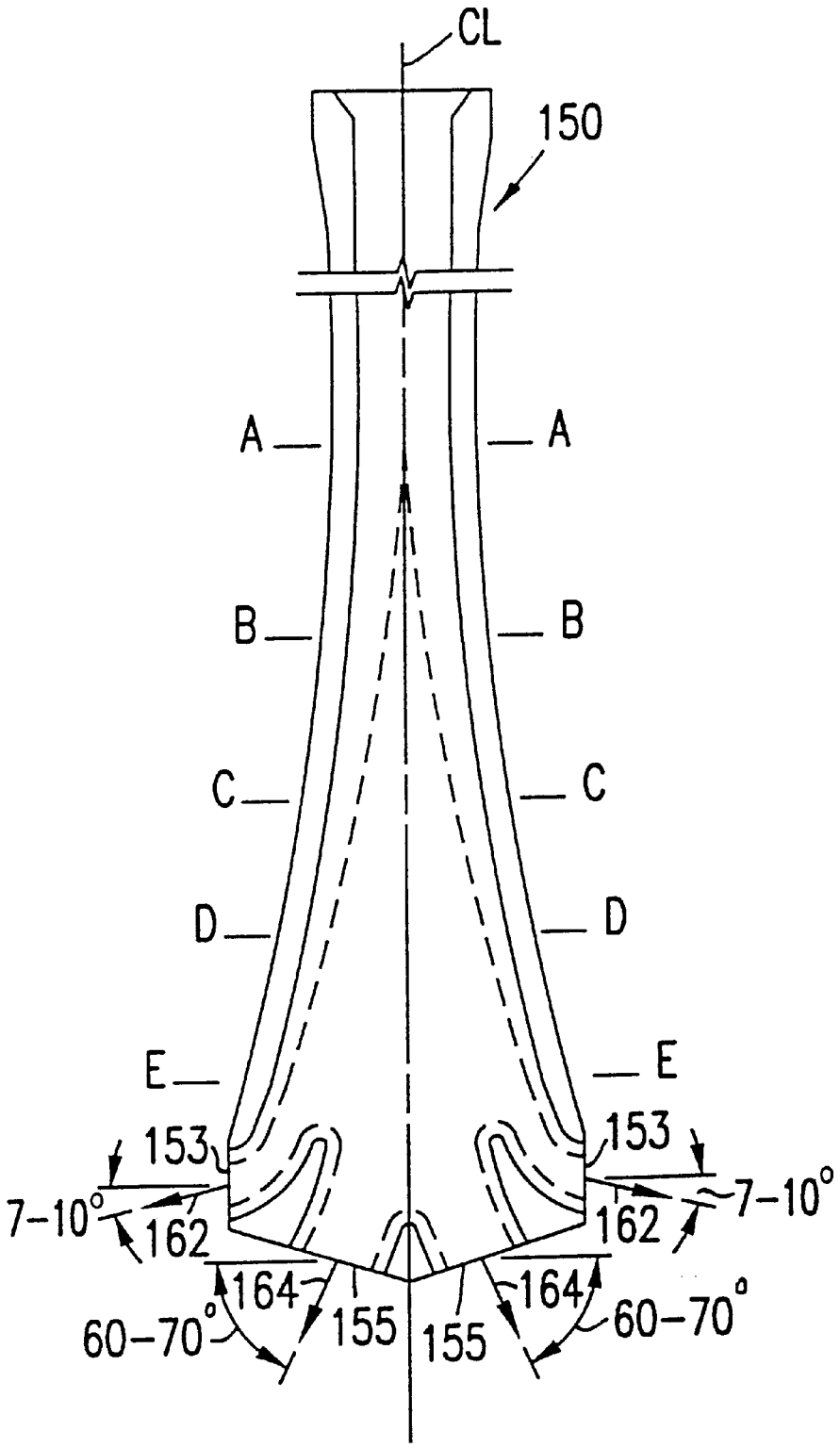
FIG. 34A shows an axial sectional view of the casting nozzle of FIG. 32 and illustrates the effective discharge angles of exit jets at low throughput flow.
Figure 34B:
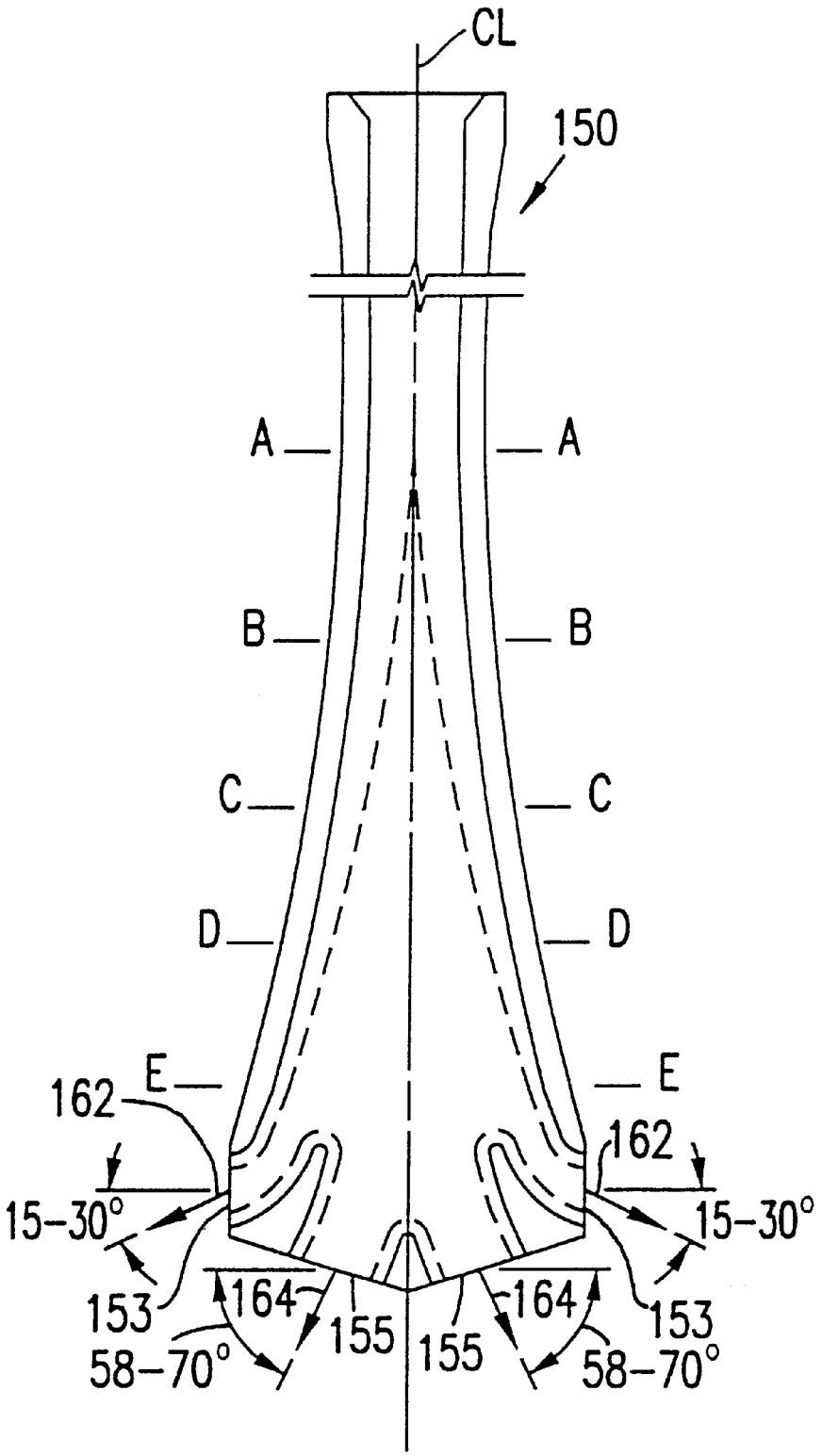
FIG. 34B shows an axial sectional view of the casting nozzle of FIG. 32 and illustrates the effective discharge angles of exit jets at medium throughput flow.
Figure 34C:
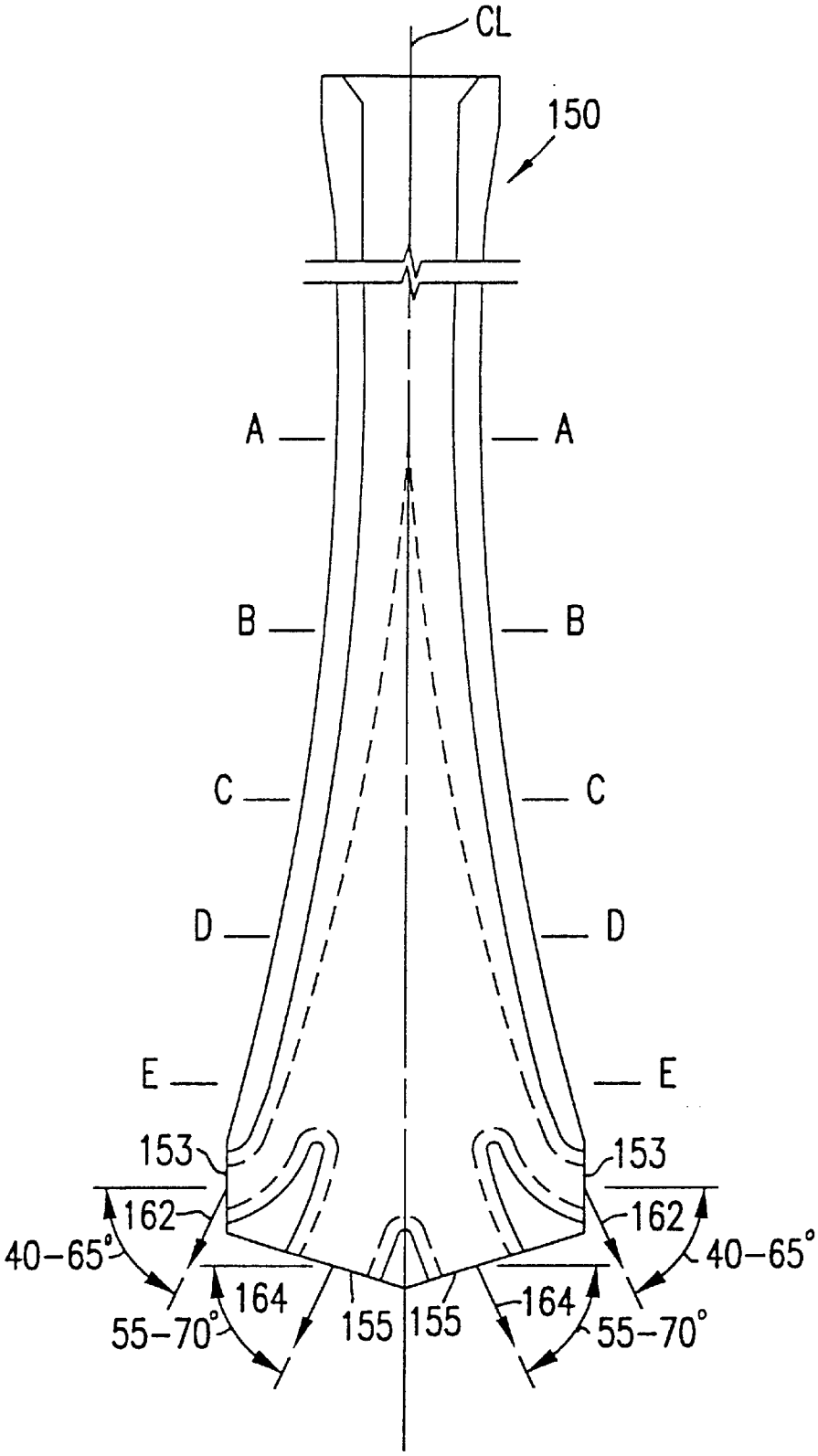
FIG. 34C shows an axial sectional view of the casting nozzle of FIG. 32 and illustrates the effective discharge angles of exit jets at high throughput flow.

FIGS. 34A–34C illustrate the variance in the effective discharge angle of the exit jets through the upper and lower exit ports as a function of flow throughput. FIGS. 34A–34C illustrate the effective discharge angles of the exit jets at low, medium and high flow throughputs, respectively, through casting nozzle 150. For example, a low flow throughput would be less than or about 1.5 to 2 tons/minute, a medium flow throughput about 2–3 tons/minute, and a high flow throughput about 3 or more tons/minute.

At low flow throughput as shown in FIG. 34A, the exit jets exiting the upper exit ports 153, represented by arrows 162, are independent of the lower exit jets, represented by arrows 164, and substantially achieve the theoretical discharge angle of the upper exit ports 153 (preferably about 7–10° from the horizontal).

As flow throughput increases as shown in FIGS. 34B and 34C, the upper exit jets 162 are drawn downward towards the center line CL of the casting nozzle 150 by the higher momentum associated with the lower exit jets 164 exiting the lower exit ports 155. Thus, the effective discharge angle of the upper exit jets 162 increases from the theoretical discharge angle (a larger angle downward from the horizontal) as flow throughput increases. The effective discharge angles of the upper exit jets 162 also becomes less divergent from the discharge angle of the lower exit jets as the flow throughput increases.

As flow throughput increases as shown in FIGS. 34B and 34C, the lower exit jets 164 exiting the lower exit ports 155 also varies slightly. The lower exit jets 164 are drawn slightly upward away from the center line CL of the casting nozzle 150. Thus, the effective discharge angle of the lower exit jets 164 slightly decreases from the theoretical discharge angle (a smaller angle downward from the horizontal) as flow throughput increases.

It should be known that for purposes of the present invention, the exact values of the low, medium, and high flow throughput are not of any particular importance. It is only necessary that whatever the values are, the effective discharge angle of the upper exit jets increases from the theoretical discharge angle (a larger angle downward from the horizontal) as flow input increases.

The varying effective discharge angle of the upper exit jets 162 with rate of flow throughput is highly beneficial. At low flow throughput, it is desirable to evenly deliver the hot incoming liquid metal to the meniscus region of the liquid in the mold so as to promote proper heat transfer to the mold powder for proper lubrication. The shallow effective discharge angle of the upper exit jets 162 at low flow throughput accomplishes this objective. In contrast, at higher flow throughput, the mixing energy delivered by the exit jets to the mold is much higher. Consequently, there is a substantially increased potential for excessive turbulence and/or meniscus disturbance in the liquid within the mold. The steeper, or more downward, effective discharge angle of the upper exit jets 162 at higher flow throughput effectively reduces such turbulence or meniscus disturbance. Accordingly, the casting nozzle 150 of FIGS. 32–34 enhances the delivery and proper distribution of liquid metal within the mold across a substantial range of flow throughputs through the casting nozzle 150.

Figure 36:
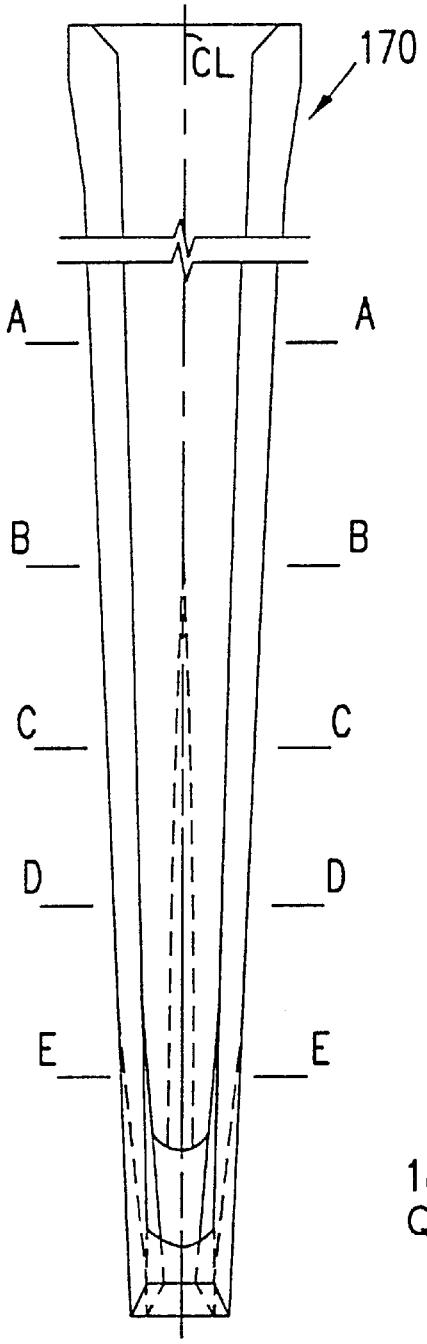
FIG. 36 shows a side axial sectional view of the casting nozzle of FIG. 35.
Figure 35:
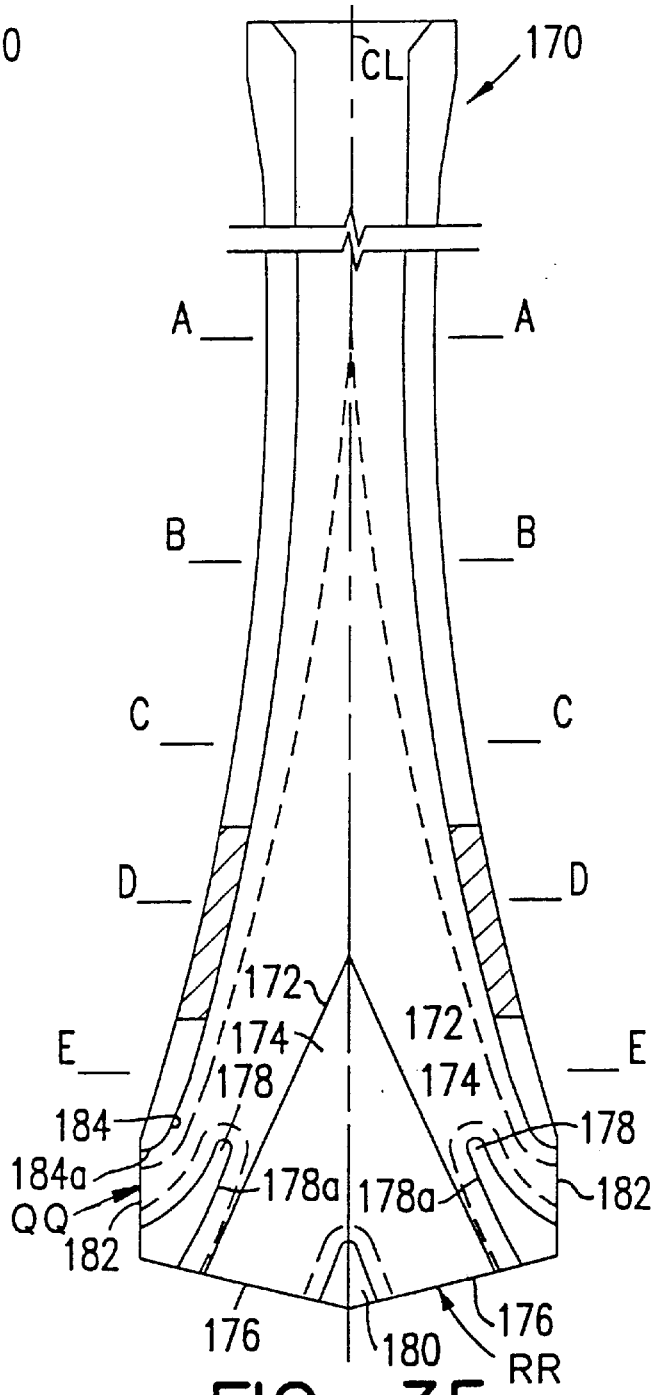
FIG. 35 shows an axial sectional view of an alternative embodiment of a casting nozzle of the present invention.
Figure 35A:
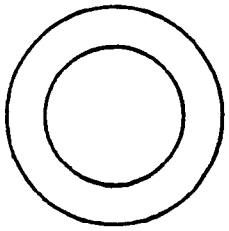
FIG. 35A shows a cross-sectional view of FIG. 35 taken across line A—A of FIG. 35.
Figure 35E:
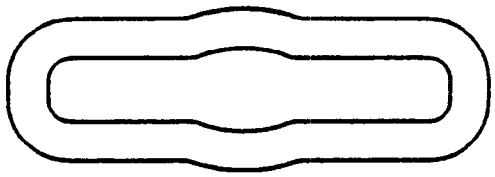
FIG. 35E shows a cross-sectional view of FIG. 35 taken across line E—E of FIG. 35.
Figure 35B:
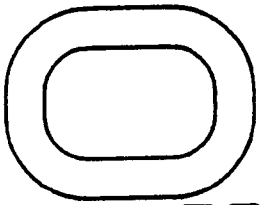
FIG. 35B shows a cross-sectional view of FIG. 35 taken across line B—B of FIG. 35.

Referring now to FIGS. 35 and 36, there is shown another alternative embodiment of the present invention. The casting nozzle 170 shown in FIGS. 35 and 36 combines features of casting nozzle 140 of FIGS. 30–31 and casting nozzle 150 of FIGS. 32–34.

Figure 35Q:
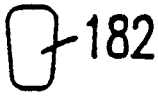
FIG. 35QQ is a partial plan view of an upper exit port of the casting nozzle of FIG. 35 looking along arrow QQ.
Figure 35C:
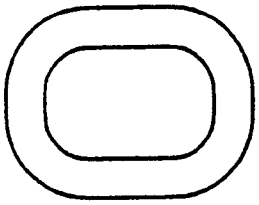
FIG. 35C shows a cross-sectional view of FIG. 35 taken across line C—C of FIG. 35.
Figure 35D:
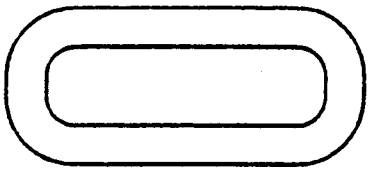
FIG. 35D shows a cross-sectional view of FIG. 35 taken across line D—D of FIG. 35.
Figure 35R:
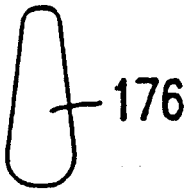
FIG. 35RR is a partial plan view of a lower exit port of the casting nozzle of FIG. 35 looking along arrow RR.

The multi-faceted diamond-back internal geometry of casting nozzle 140 of FIGS. 30–31 is incorporated in casting nozzle 170 such that top edges 172 of bending facets 174 are aligned with the theoretical discharge angle of lower exit ports 176, i.e., about 45–80° downward from the horizontal, although about 60–70° is preferred. Thus, the bending facets 174 are provided generally in the vicinity of the central stream which flows between baffles 178. The diamond-back internal geometry promotes a smoother bending and splitting of the central stream in the direction of the discharge angles of the lower exit ports 176 without separation of flow along bottom faces 178*a* of baffles 178. As shown in FIG. 35RR, the lower exit port 176 is preferably widest toward the bottom than at the top, i.e., wider near flow divider 180. As shown in FIG. 35QQ, the upper exit port 182 is preferably widest toward the top than at the bottom, i.e., widest near lower faces 184*a* of sidewalls 184.

Furthermore, as with casting nozzle 150 of FIGS. 32–34, the flow through casting nozzle 170 is preferably divided by baffles 178 into flow streams which are discharged through upper and lower exit ports 182 and 176, respectively, and the flow through casting nozzle 170 is preferably proportioned to vary the effective discharge angle of the streams exiting the upper exit ports based on flow throughput.

The effective discharge angle of the upper exit ports 182 will vary in a manner similar to that of casting nozzle 150 as shown in FIGS. 34A–34C. However, as a result of the multi-faceted diamond-back internal geometry of casting nozzle 170, casting nozzle 170 produces smoother exit jets from the lower exit ports 176 at high flow throughput with less variance in effective discharge angle and more consistent control of the meniscus variation due to waving and turbulence in the mold as compared to casting nozzle 150.

Moreover, the multi-faceted diamond-back internal geometry of casting nozzle 170 contributes to more efficient proportioning of a greater proportion of the flow out of the lower exit ports 176 than the upper exit ports 182. The diamond-back internal geometry is preferably configured so that about 15–45%, preferably about 25–40%, of the total flow exits through the upper exit ports 182 while about 55–85%, preferably about 60–75%, of the total flow exits through the lower exit ports 176, or single exit port 176 if casting nozzle 170 does not include a flow divider 180.

It will be seen that we have accomplished at least some of the objects of our invention. By providing diffusion and deceleration of flow velocity between the inlet pipe and the outlet ports, the velocity of flow from the ports is reduced, velocity distribution along the length and width of the ports is rendered generally uniform, and standing wave oscillation in the mold is reduced. Deflection of the two oppositely directed streams is accomplished by providing a flow divider which is disposed below the transition from axial symmetry to planar symmetry. By diffusing and decelerating the flow in the transition, a total stream deflection of approximately plus and minus 30° from the vertical can be achieved while providing stable, uniform velocity outlet flows.

In addition, deflection of the two oppositely directed streams can be accomplished in part by providing negative pressures at the outer portions of the streams. These negative pressures are produced in part by increasing the divergence angles of the side walls downstream of the main transition. Deflection can be provided by curved sections wherein the inner radius is an appreciable fraction of the outer radius. Deflection of flow within the main transition itself can be accomplished by providing the transition with a hexagonal cross-section having respective pairs of front and rear walls which intersect at included angles of less than 180°. The flow divider is provided with a rounded leading edge of sufficient radius of curvature to prevent vagaries in stagnation point due either to manufacture or to slight flow oscillation from producing a separation of flow at the leading edge which extends appreciably downstream.

The casting nozzles of FIGS. 23–28 improve the flow behavior associated with the introduction of liquid metal into a mold via a casting nozzle. In prior art nozzles, the high inertial forces of the liquid metal flowing in the bore of the nozzle led to flow separation in the region of the exit ports causing high velocity, and unstable, turbulent, exit jets which do not achieve their apparent flow deflection angles.

With the casting nozzles of FIGS. 23–28, the inertial force is divided and better controlled by dividing the flow into separate and independent streams within the bore of the nozzle in a multiple stage fashion. This results in the alleviation of flow separation, and therefore the reduction of turbulence, stabilizes the exit jets, and achieves a desired deflection angle.

Moreover, the casting nozzle of FIGS. 28–29 provide the ability to achieve independent deflection angles of the outer and inner streams. These casting nozzles are particularly suited for casting processes where the molds of are of a confined geometry. In these cases, it is desirable to distribute the liquid metal in a more diffuse manner.

With the casting nozzle of FIGS. 30–31, a multi-faceted internal geometry is incorporated in which the bore of the nozzle has a greater thickness at the center line of the nozzle than at the edges, creating a diamond-back internal geometry. As a result, more open area can be designed into the bore of the casting nozzle without increasing the external dimensions of the nozzle around the narrow face sidewall edges. Consequently, the nozzle provides improved flow deceleration, flow diffusion and flow stability within the interior bore of the nozzle, thereby improving the delivery of the liquid metal to the mold in a quiescent and smooth manner. Moreover, the diamond-back geometry is particularly suited to a bulged or crown-shaped mold geometry wherein the mold is thicker in the middle of the broad face and narrower at the narrow face sidewalls, because the casting nozzle better utilizes the available space within the mold to promote a proper flow pattern therein.

With the multi-port casting nozzle of FIGS. 32–34, delivery of liquid metal to, and distribution of liquid metal within, the mold is improved across a wide useful range of total flow throughputs through the casting nozzle. By properly proportioning the amount of flow that is distributed between the upper and lower exit ports of the multi-port casting nozzle, and by separating the theoretical discharge angle of the upper and lower ports by at least about 15°, the effective discharge angle of the upper exit ports will vary with an increase or decrease in casting nozzle throughput in a beneficial manner. The result of such variance is a smooth, quiescent meniscus in the mold with proper heat transfer to the mold powder at low flow throughputs, combined with the promotion of meniscus stability at high flow throughputs. Therefore, a wider useful range of operational flow throughputs can be achieved without degradation of flow characteristics as compared to prior art casting nozzles.

With the casting nozzle of FIGS. 35 and 36, the effective discharge angle of the upper exit ports advantageously varies with flow throughput in a manner similar to that of the casting nozzle of FIGS. 32–34 and, in combination with a diamond-back multi-faceted internal geometry similar to that of the casting nozzle of FIGS. 30–31, the casting nozzle of FIGS. 35 and 36 produces smooth exit jets from the lower exit ports at high flow throughput with less variance in effective discharge angle and more consistent control of meniscus variation in the mold.

It will be understood that certain features and subcombinations are of utility and may be employed without reference to other features of subcombinations. This is contemplated by and is within the scope of our claims. It is therefore to be understood that our invention is not to be limited to the specific details shown and described.

What is claimed is:

1. A casting nozzle for flowing liquid metal therethrough comprising:

an elongated bore having a central axis, at least one entry port and at least one exit port, and at least one side edge extending towards the at least one exit port, the bore including an enlarged portion located at least at the at least one exit port to provide the bore with greater cross-sectional area near the central axis than near at least one edge of the bore.

2. The casting nozzle of claim 1, wherein the bore includes an inner surface, and the enlarged portion includes at least first and second bending facets defined by at least a first arcuately recessed portion of the inner surface of the bore which extends from a substantially narrow apex to a substantially broader edge located toward the at least one exit port.

3. The casting nozzle of claim 2, further comprising a flow divider positioned in a path of the liquid metal and downstream of the at least one baffle to divide the at least one exit port into two exit ports and to divide the flow of liquid metal through the bore into two streams which exit the nozzle through the two exit ports.

4. The casting nozzle of claim 3, wherein each bending facet includes an upper edge, the upper edges divergently extending from the apex to the broader edge such that the upper edges circumscribe the first arcuately recessed portion.

5. The casting nozzle of claim 4, wherein the inner surface of the elongated bore includes oppositely disposed inner surface areas, the first arcuately recessed portion being disposed at one of the inner surface areas, the elongated bore including a second arcuately recessed portion disposed at the opposite inner surface area;

the second arcuately recessed portion including third and fourth bending facets having features which are mirror images of the first and second bending facets, respectively.

6. The casting nozzle of claim 5, wherein the first and second bending facets and the third and fourth bending facets are adjacent at respective central edges.

7. The casting nozzle of claim 6, wherein the central edges of the first and second bending facets and the third and fourth bending facets are more distant from a lengthwise horizontal axis of the casting nozzle than the upper edg of each bending facet within a horizontal cross-section.

8. The casting nozzle of claim 4, wherein each upper edge extends at an angle toward the at least one exit port, the angle generally matching a discharge angle of the exit port.

9. The casting nozzle of claim 8, wherein the discharge angle of each exit port is about 45–80° downward from the horizontal.

10. The casting nozzle of claim 8, wherein the discharge angle of each exit port is about 60–70° downward from the horizontal.

11. The casting nozzle of claim 1, wherein the at least one exit port has a top and a bottom, and the exit port is wider at the bottom than at the top.

12. A casting nozzle for flowing liquid metal therethrough comprising:

an elongated bore having a central axis, at least one entry port and at least one exit port, and at least one side edge extending towards the at least one exit port, the bore including an enlarged portion to provide the bore with greater cross-sectional area near the central axis than near the at least one edge of the bore, and the at least one exit port including a top and a bottom, wherein the exit port is wider at the bottom than at the top.

13. A casting nozzle for flowing liquid metal therethrough comprising:

an elongated bore having a central axis, an inner surface having at least one inner edge, and at least one entry port and at least one exit port, the bore including an enlarged portion to provide the bore with greater cross-sectional area near the central axis than near the at least one edge of the bore, and the enlarged portion including at least first and second bending facets defined by at least a first arcuately recessed portion of the inner surface of the bore which extends from a substantially narrow apex to a substantially broader edge located toward the at least one exit port.

14. The casting nozzle of claim 13, further comprising a flow divider positioned in a path of the liquid metal and downstream of the at least one baffle to divide the at least one exit port into two exit ports and to divide the flow of liquid metal through the bore into two streams which exit the nozzle through the two exit ports.

15. The casting nozzle of claim 14, wherein each bending facet includes an upper edge, the upper edges divergently extending from the apex to the broader edge such that the upper edges circumscribe the first arcuately recessed portion.

16. The casting nozzle of claim 15, wherein the inner surface of the elongated bore includes oppositely disposed inner surface areas, the first arcuately recessed portion being disposed at one of the inner surface areas, the elongated bore including a second arcuately recessed portion disposed at the opposite inner surface area, the second arcuately recessed portion including third and fourth bending facets having features which are mirror images of the first and second bending facets, respectively.

17. The casting nozzle of claim 16, wherein the first and second bending facets and the third and fourth bending facets are adjacent at respective central edges.

18. The casting nozzle of claim 17, wherein the central edges of the first and second bending facets and the third and fourth bending facets are more distant from a lengthwise horizontal axis of the casting nozzle than the upper edge of each bending facet within a horizontal cross-section.

19. The casting nozzle of claim 15, wherein each upper edge extends at an angle toward the at least one exit port, the angle generally matching a discnarge angle of the exit port.

20. The casting nozzle of claim 19, wherein the discharge angle of each exit port is about 45–80° downward from the horizontal.

21. The casting nozzle of claim 19, wherein the discharge angle of each exit port is about 60–70° downward from the horizontal.

22. The casting nozzle of claim 13, wherein the at least one exit port has a top, a bottom, and the exit port is wider at the bottom than at the top.

* * * * *